US007253788B2

(12) United States Patent
Choi et al.

(10) Patent No.: US 7,253,788 B2
(45) Date of Patent: Aug. 7, 2007

(54) MIXED-SIGNAL SYSTEMS WITH ALTERNATING IMPEDANCE ELECTROMAGNETIC BANDGAP (AI-EBG) STRUCTURES FOR NOISE SUPPRESSION/ISOLATION

(75) Inventors: Jinwoo Choi, Austin, TX (US); Madhavan Swaminathan, Marietta, GA (US); Vinu Govind, Decatur, GA (US)

(73) Assignee: Georgia Tech Research Corp., Atlanta, GA (US)

( * ) Notice: Subject to any disclaimer, the term of this patent is extended or adjusted under 35 U.S.C. 154(b) by 73 days.

(21) Appl. No.: 11/260,952

(22) Filed: Oct. 28, 2005

(65) Prior Publication Data

US 2006/0092093 A1 May 4, 2006

Related U.S. Application Data

(63) Continuation-in-part of application No. 10/936,774, filed on Sep. 8, 2004.

(51) Int. Cl.
*H01Q 15/02* (2006.01)

(52) U.S. Cl. ..... 343/909; 343/754

(58) Field of Classification Search ..... 343/909, 343/754, 700 MS

See application file for complete search history.

(56) References Cited

U.S. PATENT DOCUMENTS 5,923,225 A 7/1999 De Los Santos ..... 333/12
6,538,621 B1 3/2003 Sievenpiper et al. ..... 343/909
6,967,282 B2 * 11/2005 Tonomura et al. ..... 174/392
7,030,463 B1 * 4/2006 Subramanyam et al. .... 257/595
7,042,419 B2 * 5/2006 Werner et al. ..... 343/909
2004/0140945 A1 7/2004 Werner et al.
2004/0239451 A1 12/2004 Ramprasad et al.

OTHER PUBLICATIONS

Sievenpiper, et al; High-Impedance Electromagnetic Surfaces With a Forbidden Frequency Band; IEEE Transactions on Microwave Theory and Techniques; vol. 47, No. 11; Nov. 1999; pp. 2059-2074, no date avail.

Abhari, et al.; Metallo-Dielectric Electromagnetic Bandgap Structures for Suppression and Isolation of the Parallel-Plate Noise in High-Speed Circuits; IEEE Transactions on Microwave Theory and Techniques; vol. 51, No. 6; Jun. 2003; pp. 1629-1639.

Choi, et al.; Isolation in Mixed-Signal Systems Using a Novel Electromagnetic Bandgap (EBG) Structure; School of Electrical and Computer Engineering, Georgia Institute of Technology; 4 pages, no date avail.

Kamgaing, et al.; A Novel Power Plane With Integrated Simultaneous Switching Noise Mitigation Capability using HIgh Impedance Surface; IEEE Microwave and Wireless Components Letters; vol. 13, No. 1; Jan. 2003; pp. 21-23.

Choi, et al.; A Novel Electromagnetic Bandgap (EBG) Structure for Mixed-Signal System Applications; School of Electrical and Computer Engineering, Georgia Institute of Technology, 4 pages, no date avail.

Kamgaing; et al.; Inductance-Enhanced High-Impedance Surfaces for Broadband Simultaneous Switching Noise Mitigation in Power Planes; IEEE MTT-S Digest; 2003; pp. 2165-2168.

* cited by examiner

*Primary Examiner*—Hoang V. Nguyen
(74) *Attorney, Agent, or Firm*—Thomas, Kayden, Horstemeyer & Risley, LLP

(57) ABSTRACT

Alternating impedance electromagnetic bandgap (AI-EBG) structures, systems incorporating AI-EBG structures, and methods of making AI-EBG structures, are disclosed.

17 Claims, 17 Drawing Sheets

MIXED-SIGNAL SYSTEMS WITH ALTERNATING IMPEDANCE ELECTROMAGNETIC BANDGAP (AI-EBG) STRUCTURES FOR NOISE SUPPRESSION/ISOLATION

CLAIM OF PRIORITY TO RELATED APPLICATION

This application claims priority to and is a continuation-in-part of copending U.S. utility application entitled, "An Electromagnetic Bandgap Structure For Isolation In Mixed-Signal Systems," having Ser. No. 10/936,774, filed Sep. 8, 2004, which is entirely incorporated herein by reference.

This application claims priority to co-pending U.S. provisional application entitled "Design Methodologies In Mixed-Signal Systems With Alternating Impedance Electromagnetic Bandgap (AI-EBG) Structure" having Ser. No. 60/679,540, filed on May 10, 2005, which is entirely incorporated herein by reference.

TECHNICAL FIELD

The present disclosure is generally related to noise suppression/isolation for mixed-signal systems in which RF/analog and digital circuits exist together, filters, and more particularly, is related to tunable electromagnetic bandgap structures.

BACKGROUND

Radio frequency (RF) front-end circuits like low noise amplifiers (LNAs) need to detect low-power signals and are therefore extremely sensitive by nature. A large noise spike, either in or close to the operating frequency band of the device, can de-sensitize the circuit and destroy its functionality. To prevent this problem, all radio architectures include filters and other narrow band circuits, which prevent the noise in the incoming spectrum from reaching the LNA. However, there are no systematic ways to filter noise from other sources, such as noise coupling through the power supply and appearing at the output of the LNA, where it can degrade the performance of the downstream circuits.

The sensitivity of RF circuits to power supply noise has resulted in difficulties for integration of digital and RF/analog sub-systems on packaging structures. One typical approach to isolate the sensitive RF/analog circuits from the noisy digital circuits is to split the power plane or both power and ground planes. The gap in power plane or ground plane can partially block the propagation of electromagnetic waves. For this reason, split planes are usually used to isolate sensitive RF/analog circuits from noisy digital circuits. Although split planes can block the propagation of electromagnetic waves, part of the electromagnetic energy can still couple through the gap. Due to the electromagnetic coupling, this method only provides a marginal isolation (i.e., −20 dB to −60 dB) at high frequencies (i.e., above ~1 GHz) and becomes ineffective as the sensitivity of RF circuits increases and operating frequency of the system increases. At low frequencies (i.e., below ~1 GHz), split planes provide an isolation of −70 dB to −80 dB.

In addition, split planes sometimes require separate power supplies to maintain the same DC level, which is not cost-effective. Therefore, the development of a better noise isolation method is needed for good performance of a system having a RF/analog circuit and a digital circuit.

Furthermore, as systems become more compact, multiple power supplies become a luxury that the designer cannot afford. The use of ferrite beads have been suggested as a solution to these problems, enabling increased isolation as well as the use of a single power supply. However, due to the high sensitivity of RF circuitry, the amount of isolation provided by ferrite beads again tends to be insufficient at high frequencies.

Electromagnetic bandgap (EBG) structures have become very popular due to their enormous applications for suppression of unwanted electromagnetic mode transmission and radiation in the area of microwave and millimeter waves. EBG structures are periodic structures in which propagation of electromagnetic waves is not allowed in a specified frequency band. In recent years, EBG structures have been proposed to suppress simultaneous switching noise (SSN) in a power distribution network (PDN) in high-speed digital systems for antenna applications. These EBG structures have a thick dielectric layer (60 mils to 180 mils) that exists between the power plane and the ground plane. In addition, these EBG structures require an additional metal layer with via connections. Thus, these EBG structures are expensive solutions for printed circuit board (PCB) applications.

Accordingly, there is a need in the industry to address the aforementioned deficiencies and/or inadequacies.

SUMMARY

Alternating impedance electromagnetic bandgap (AI-EBG) structures, systems incorporating AI-EBG structures, and methods of making AI-EBG structures, are disclosed. A representative embodiment of a structure, among others, includes a first layer, wherein the first layer comprises a signal layer; a second layer disposed on a back side of the first layer, wherein the second layer comprises a dielectric layer; a third layer disposed on a back side of the second layer, wherein the third layer comprises a solid metal plane; a fourth layer disposed on a back side of the third layer, wherein the fourth layer comprises a dielectric layer; and a fifth layer disposed on a back side of the fourth layer, wherein the fifth layer comprises an alternating impedance electromagnetic bandgap (AI-EBG) plane.

The AI-EBG plane includes a plurality of first elements disposed on a first plane, each first element comprising a first metal layer, wherein each first element has a rectangular shape; and a second element connecting each first element to an adjacent first element at a position adjacent to the corner of the first element, the second element being disposed on the first plane, the second element comprising the first metal layer, wherein the first elements and second elements substantially filter electromagnetic waves to a stopband floor of about −60 dB to about −140 dB in a bandgap of about 100 MHz to about 50 GHz, having a width selected from about 1 GHz, 2 GHz, 3 GHz, 5 GHz, 10 GHz, 20 GHz, and 30 GHz, and having a center frequency positioned at a frequency from about 1 GHz to 37 GHz.

A representative method of fabricating an AI-EBG structure, among others, includes providing a first layer, wherein the first layer comprises a signal layer; disposing a second layer on a back side of the first layer, wherein the second layer comprises a dielectric layer; disposing a third layer on a back side of the second layer, wherein the third layer comprises a solid metal plane; disposing a fourth layer on a back side of the third layer, wherein the fourth layer comprises a dielectric layer; and disposing a fifth layer on a back side of the fourth layer, wherein the fifth layer comprises an alternating impedance electromagnetic bandgap (AI-EBG) plane.

Other structures, systems, methods, features, and advantages of the present disclosure will be, or become, apparent to one with skill in the art upon examination of the following drawings and detailed description. It is intended that all such additional structures, systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 25 illustrates a measured output spectrum of the LNA: (a) illustrates when the FPGA is completely switched off and (b) illustrates when the FPGA is switched on.

DETAILED DESCRIPTION

Structures and systems having alternating impedance electromagnetic bandgap (AI-EBG) structures or planes and methods of fabrication thereof are described. Embodiments of the structures (hereinafter "AI-EBG structures") provide deeper stopband and wider stopband, which provides better noise suppression than other EBG structures. In addition, embodiments of the AI-EBG structure maintain signal integrity (e.g., maintaining signal integrity ensures signals are undistorted and do not cause problems to themselves, to other components in the system, or to other systems nearby) and limit electromagentic interference (EMI). Further, embodiments of the AI-EBG structure provide tunable isolation between RF/analog circuits and digital circuits in certain frequency bandgaps.

The AI-EBG structure can be used in mixed signal systems and high-speed digital systems. For example, the AI-EBG structures can be included in, but are not limited to, cellular systems, power distribution systems in mixed-signal package and board, power distribution systems in a high-speed digital package and board, power distribution networks in RF systems, and combinations thereof. The compact design of the AI-EBG structure is particularly well suited for devices or systems requiring minimization of the size of the structure.

In general, the AI-EBG structure includes a stacking structure that includes, but is not limited to, a signal layer, an AI-EBG plane, and a solid metal plane. The design methodology of the stacking of layers and planes provides an AI-EBG structure that operates in mixed-signal systems while maintaining signal integrity, reducing EMI, and reducing noise. By using the solid metal plane as the reference plane for the signal layer in mixed-signal systems, the AI-EBG structure substantially avoids signal integrity and EMI problems, while the AI-EBG plane suppresses noise.

Figure 4A:
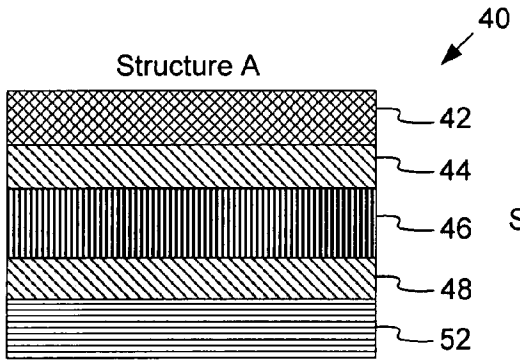
FIGS. 4A through 4C illustrate embodiments of the structures including alternating impedance electromagnetic bandgap (AI-EBG) planes.
Figure 4B:
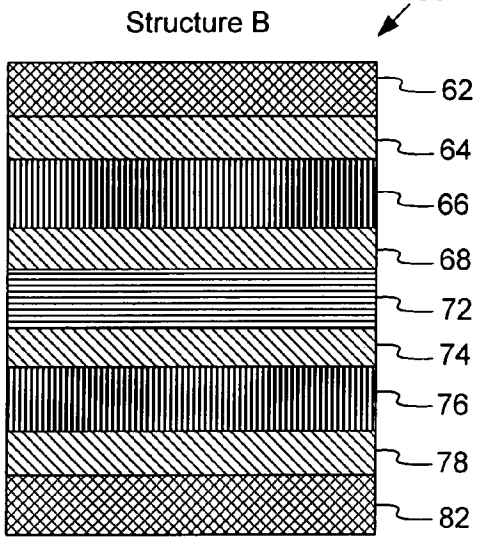
Figure 4C:
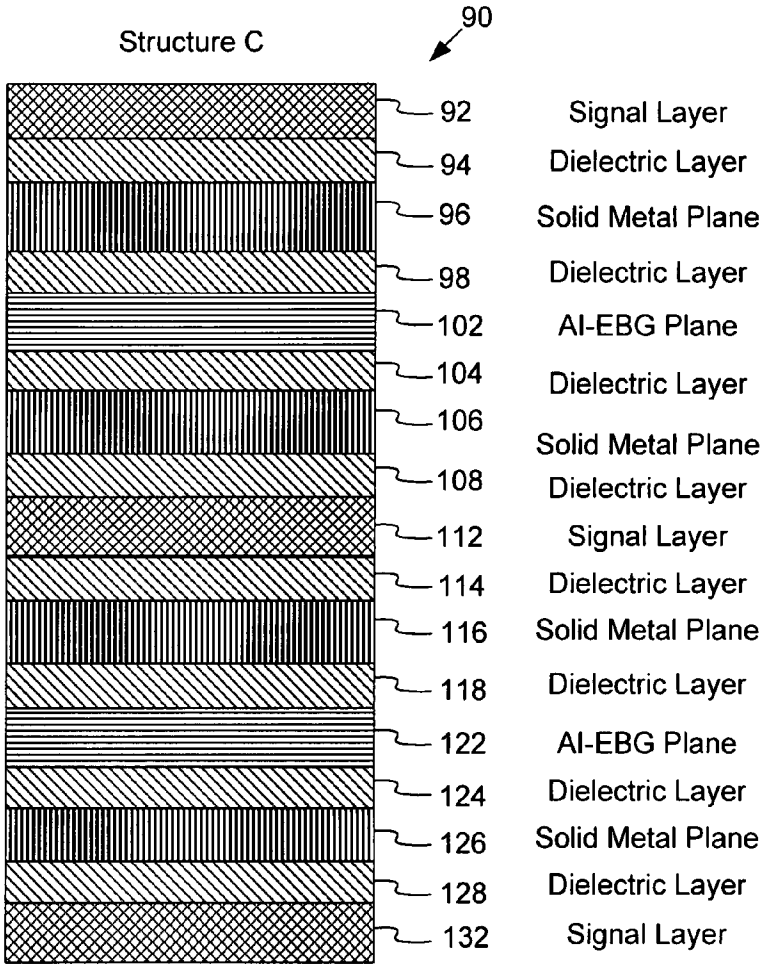

The stacking configurations illustrated in FIGS. 4A through 4C show a number of embodiments employing the design methodology described herein to design AI-EBG structures that substantially avoid signal integrity and EMI problems and suppress noise. It is contemplated that other designs not shown in FIGS. 4A through 4C can be used to substantially avoid signal integrity and EMI problems and suppress noise, and that the design methodology described herein describes such embodiments.

In regard to the AI-EBG plane, the AI-EBG plane includes a plurality of first elements, where each first element is connected to another first element by a second element, thereby forming a continuous, two-dimensional, and periodic structure in the same dimensional plane. Unlike mushroom-type EBG structures, the AI-EBG structure is relatively simple and can be easily designed and fabricated using planar printed circuit board processes.

Although not intending to be bound by theory, the plurality of first elements can be etched in a power plane (or in a ground plane) and connected by the second elements etched in the same dimensional plane to form a distributed LC network (where L is inductance and C is capacitance). The second elements introduce additional inductance, while the capacitance is mainly formed by the first elements and the corresponding parts of the other solid plane. The resultant effect is substantial isolation of electromagnetic waves from one or more components positioned on the AI-EBG structures.

EBG structures in the two dimensional plane (i.e., xy plane) are desirable because vias are not required to interconnect components positioned in different dimensional planes. In addition, the design and fabrication are simple as compared to EBG structures having components positioned in different dimensional planes with vias and additional metal patch layers interconnecting the components. Standard planar printed circuit board (PCB) processes can be used to fabricate the structures of the present disclosure. For example, the systems having AI-EBG structures can be fabricated using a FR 4 process. In addition, the dielectric thickness can be thin (e.g., 1 mil about 4 mils) and thus lower costs.

The AI-EBG structures can be designed to have a stopband floor of about −40 dB to −140 dB, −50 dB to −140 dB, −60 dB to −140 dB, −80 dB to −140 dB, and −100 dB to −140 dB. In addition, the AI-EBG structure can be designed to have a bandgap that can range from about 100 MHz to 35 GHz, having widths of about 1 GHz, 2 GHz, 3 GHz, 5 GHz, 10 GHz, 20 GHz, and 30 GHz (e.g., about 500 MHz to 3 GHz, about 3 GHz to 8 GHz, and about 15 GHz to 50 GHz), depending on the stopband floor selected. Since the AI-EBG structure is tunable, the center frequency can be at a preselected frequency. In particular, the center frequency can be selected from a frequency from about 1 GHz to 37 GHz.

Figure 1A:
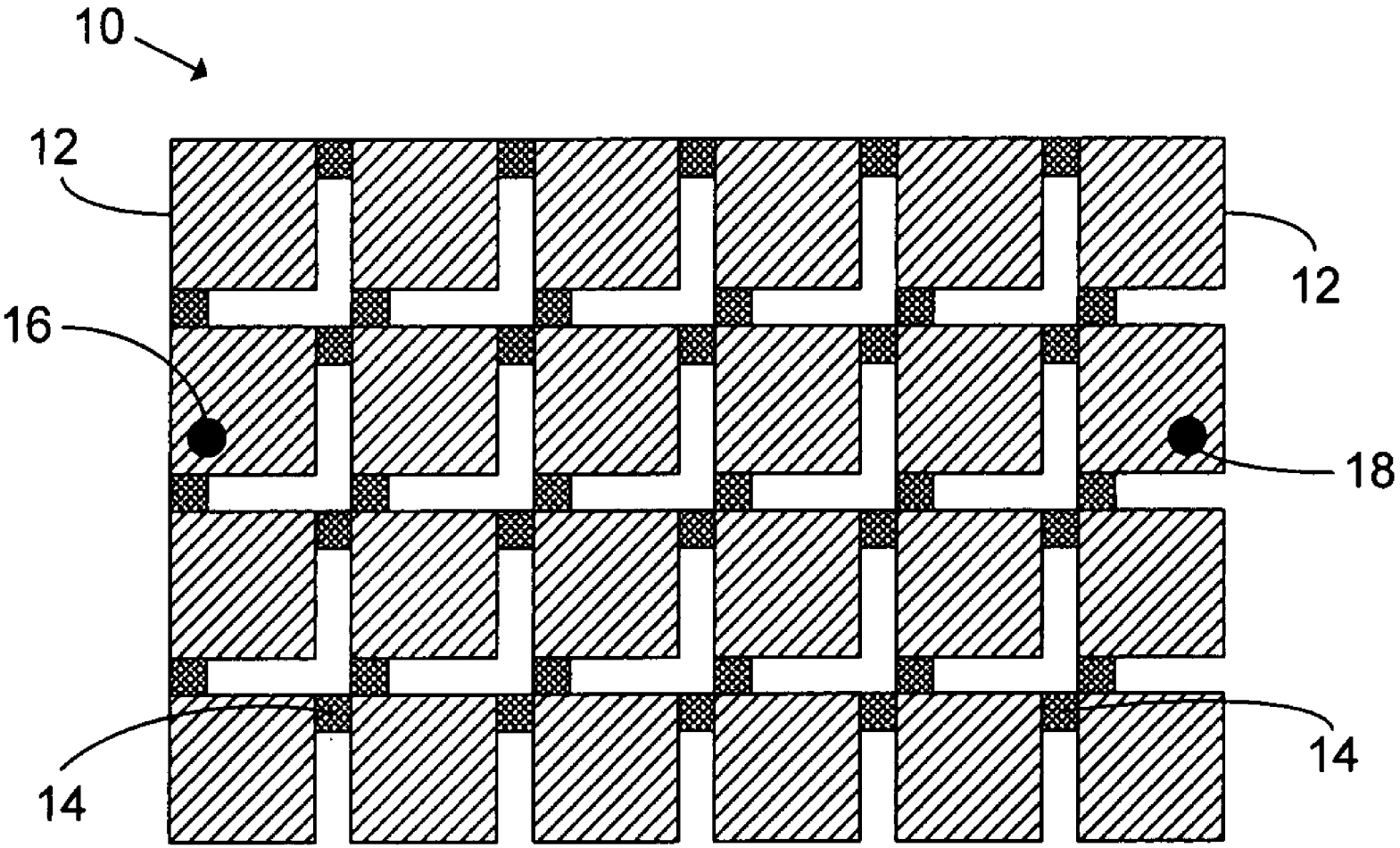
FIG. 1A illustrates a top view of one embodiment of a system having an AI-EBG structure.

FIG. 1A illustrates a top view of one embodiment of a system having an AI-EBG structure 10. The AI-EBG structure 10 has an AI-EBG plane that includes, but is not limited to, a plurality of first elements 12 continuously connected by a plurality of second elements 14 in the same dimensional plane. At a first location 16 and a second location 18, the AI-EBG plane can also include, but is not limited to, various devices or circuits. At the first location 16, the AI-EBG plane can include, but is not limited to, a port, an RF/analog circuit, and/or a digital circuit. At the second location 18, the AI-EBG plane can include, but is not limited to, a port, an RF/analog circuit, and/or a digital circuit. In one embodiment, a digital circuit is located at the first location 16, while an RF/analog circuit is located at the second location 18.

The first element 12 and the second element 14 can be various shapes. The first elements 12 illustrated in FIG. 1A have square shapes and the second elements 14 illustrated in FIG. 1A also have square shapes. By having the first elements 12 and the second elements 14 each as the same shape, the AI-EBG plane is easy to design, fabricate, and analyze.

It should be noted that the first elements 12 and the second elements 14 can also be other structures that produce sections of high and low impedance. In particular, the first elements 12 and the second elements 14 can each independently be a shape such as, but not limited to, rectangular shapes, polygonal shapes, hexagonal shapes, triangular shapes, circular shapes, or combinations thereof.

The second element 14 can be attached to the first element 12 at various positions. In FIG. 1A, the second elements 14 are attached to the corners of the square first elements 12. However, the second elements 14 can be attached at other positions on the perimeter of the first elements 12, but are shown to be disposed on the edges of the first elements 12 for the best isolation. The simulation results using TMM and a conventional full-wave solver (SONNET) confirm that the second elements 14 disposed on the edges of the first elements 12 showed better isolation than that of the second elements 14 disposed on the centers of the first elements 12.

Figure 1B:
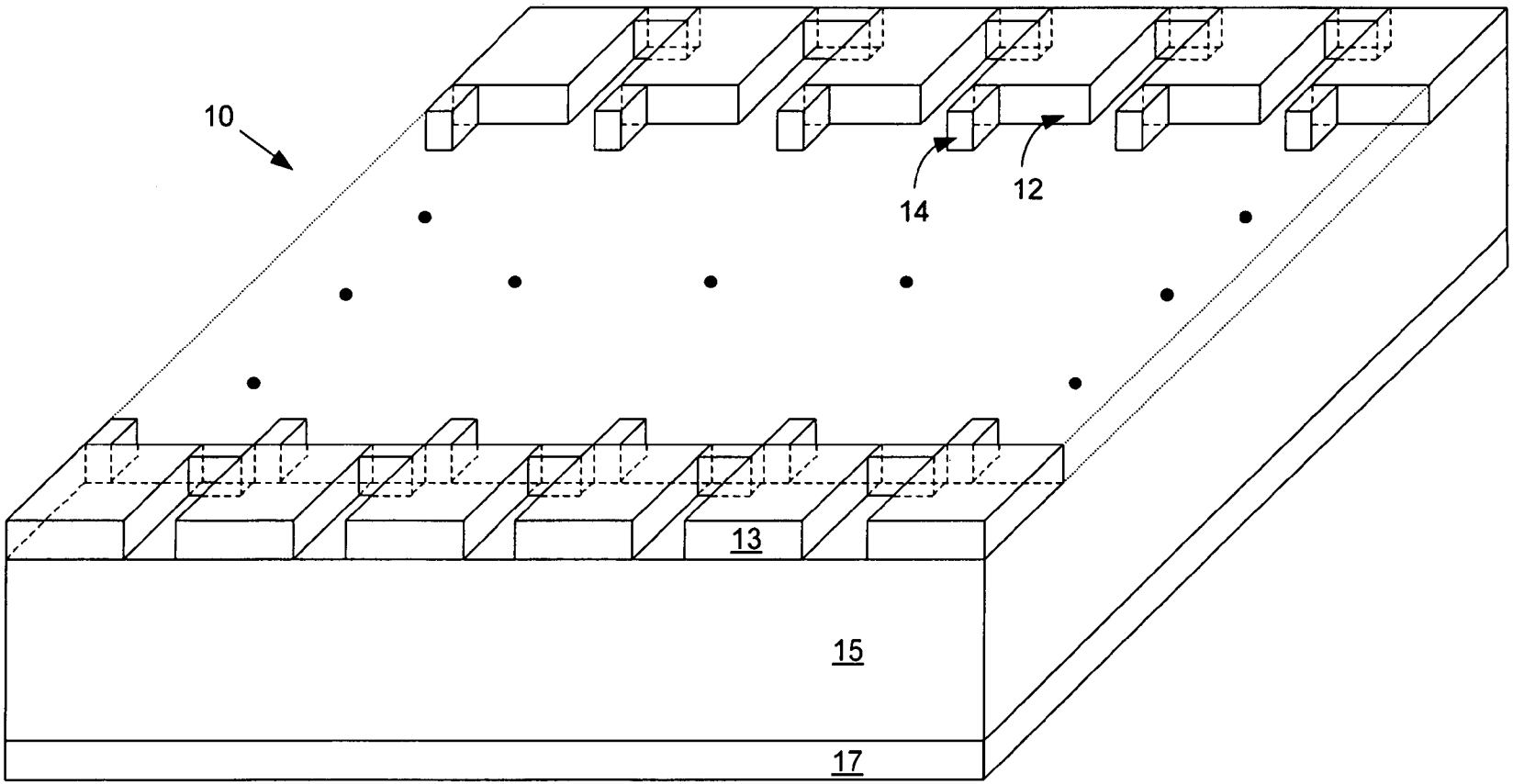
FIG. 1B illustrates a three-dimensional elevated, side view of the system having the AI-EBG structure.

FIG. 1B illustrates a three-dimensional view of the system having the AI-EBG structure 10. The system having the AI-EBG structure 10 can include, but is not limited to, a AI-EBG plane 13, a dielectric layer 15, and a solid metal plane 17. The AI-EBG plane 13 can be included in, but is not limited to, a ground plane or a power plane. For example, the AI-EBG plane 13 can be a power plane etched with first elements 12 and second elements 14 (as shown in FIG. 1B), while the solid metal plane 17 can be a continuous metal layer acting as a ground plane.

The AI-EBG plane 13 can include, but is not limited to, copper (Cu), palladium (Pd), aluminum (Al), platinum (Pt), chromium (Cr), or combinations thereof. The AI-EBG plane 13 can be, but is not limited to, any material with a conductivity ($\sigma_c$) between about $1.0\times10^6$ S/m and about $6.1\times10^6$ S/m. The AI-EBG plane 13 can have, but is not limited to, a thickness between about 1 mil and 100 mils.

The dielectric layer 15 can be, but is not limited to, a dielectric material with a dielectric constant having a relative permittivity ($\epsilon_r$) of about 2.2 to about 15, and/or a dielectric loss tangent (tan (δ)) of about 0.001 to about 0.3, and combinations thereof. The dielectric layer 15 can include, but is not limited to, FR4 ceramic, and combinations thereof. In general, FR4 is used as an insulating base material for circuit boards. FR4 is made from woven glass fibers that are bonded together with an epoxy. The board is cured using a combination of temperature and pressure that causes the glass fibers to melt and bond together, thereby giving the board strength and rigidity. "FR" stands for "Flame Retardant". FR4 is also referred to as fiberglass boards or fiberglass substrates. The dielectric layer 15 can have, but is not limited to, a thickness between about 1 mil and about 100 mils.

The solid metal plane 17 can be included in, but is not limited to, a ground plane or a power plane. The solid metal plane 17 can include, but is not limited to, Cu, Pd, Al, Pt, Cr, or combinations thereof. The solid metal plane 17 can be, but is not limited to, a material with a conductivity ($\sigma_c$) between about $1.0\times10^6$ S/m and about $6.1\times10^6$ S/m. The solid metal plane 17 can have, but is not limited to, a thickness between about 1 mil and 10 mils.

In general, the length and width of the AI-EBG structure 10 can vary depending on the application. The AI-EBG structure 10 can be fabricated to a length and a width to accommodate consumer and commercial electronics systems.

Figure 2:
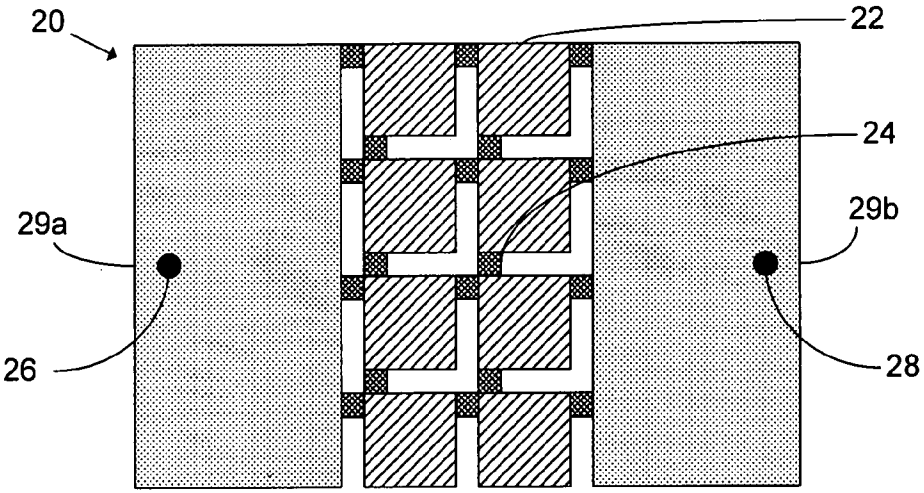
FIG. 2 illustrates a top view of another embodiment of a system having a partial AI-EBG structure.

FIG. 2 illustrates another embodiment of a system having an AI-EBG structure 20. The AI-EBG structure 20 includes, but is not limited to, a plurality of first elements 22 continuously connected by a plurality of second elements 24. The plane elements 29*a* and 29*b* can be, but are not limited to, a continuous metal layer. At a first location 26 and a second location 28, the system having the AI-EBG structure 20 can also include, but is not limited to, various devices or circuits. At the first location 26, the system having the AI-EBG structure 20 can include, but is not limited to, a port, a RF/analog circuit, and/or a digital circuit. At the second location 28, the system having the AI-EBG structure 20 can include, but is not limited to, a port, a RF/analog circuit, and/or a digital circuit. In one embodiment, a digital circuit is located at the first location 26, while an RF/analog circuit is located at the second location 28.

Figure 3:
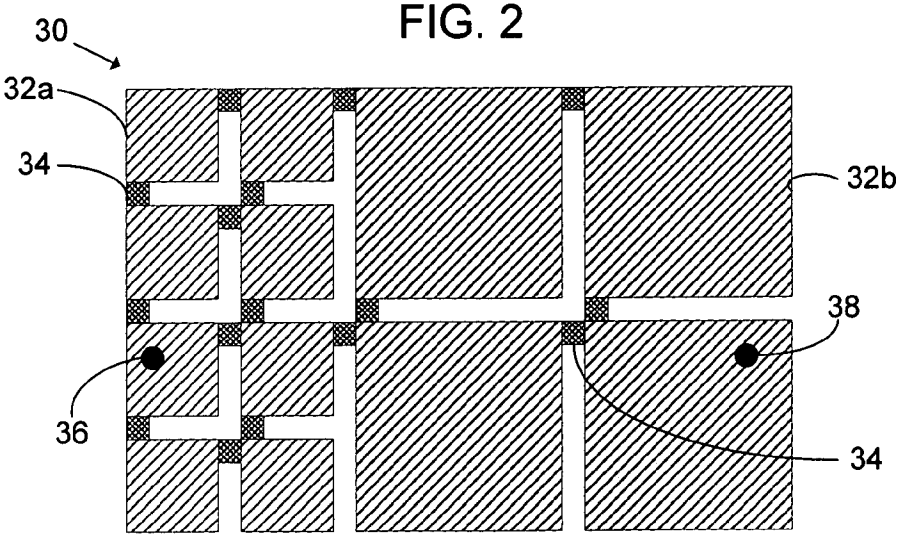
FIG. 3 illustrates a top view of another embodiment of a system having a hybrid AI-EBG structure.

FIG. 3 illustrates another embodiment of a system having an AI-EBG structure 30. The AI-EBG structure 30 includes, but is not limited to, a plurality of first elements 32*a* and 32*b* continuously connected by a plurality of second elements 34. The first elements 32*a* are smaller in size than the first elements 32*b*. At a first location 36 and a second location 38, the system having the AI-EBG structure 30 can also include, but is not limited to, various devices or circuits. At the first location 36, the system having the AI-EBG structure 30 can include, but is not limited to, a port, a RF/analog circuit, or a digital circuit. At the second location 38, the system having the AI-EBG structure 30 can include, but is not limited to, a port, an RF/analog circuit, or a digital circuit. In one embodiment, a digital circuit is located at the first location 36, while an RF/analog circuit is located at the second location 38.

Using the AI-EBG structure 30 enables the structure to obtain very wide bandgap (e.g., −40 dB bandgap ranging between 500 MHz and 10 GHz). For example, the larger first elements 32*b* and the second elements 34 can produce a bandgap from about 500 MHz to 3 GHz (−40 dB bandgap), while smaller first elements 32*a* and the second elements 34 produce a bandgap from about 3 GHz to 10 GHz (−40 dB bandgap). Thus, a AI-EBG structure can produce an ultra wide bandgap. The ratio between the first element and the second elements could be, but is not limited to, from about 4 to 300.

FIGS. 4A through 4C illustrate embodiments of the AI-EBG structure having various stack configurations. FIG. 4A illustrates structure A 40 including, but not limited to, a signal layer 42, a dielectric layer 44, a solid metal plane 46, a dielectric layer 48, and a AI-EBG plane 52. Structure A 40 substantially avoids signal integrity problems, EMI problems, and suppresses noise when used in mixed-signal systems. Variations of this stack configuration (combinations of layers/planes or multiple stacks of structure A 40) can be used to design AI-EBG structures that substantially avoid signal integrity and EMI problems and suppresses noise (AI-EBG plane) in a mixed-signal system.

The signal layer 42 is positioned on the top of the dielectric layer 44. The solid metal plane 46 is positioned on the bottom (back side) of the dielectric layer 44. The dielectric layer 48 is positioned on the bottom of the solid metal plane 46. The AI-EBG plane is positioned on the bottom of the dielectric layer 48.

Each layer or plane can be a ground plane or a power plane, and the selection of the type of layer or plane can be determined based, at least in part, on the product that the AI-EBG structure is incorporated into and the desired characteristics of the AI-EBG structure.

The dielectric layer, the solid metal plane, and the AI-EBG plane have been described in detail above. The signal layer 42 is a partial metal layer. The metal can include, but is not limited to, Cu, Pd, Al, Pt, Cr, or combinations thereof. The signal layer 42 includes transmission lines, which send signals from one place to the other place. By using the solid metal plane as the reference plane for the signal layer in mixed-signal systems, the stacking of structure A 40 substantially avoids signal integrity and EMI problems, while the AI-EBG plane suppresses noise.

FIG. 4B illustrates structure B 60 having a signal layer 62, a dielectric layer 64, a solid metal plane 66, a dielectric layer 68, a AI-EBG plane 72, a dielectric layer 74, a solid metal plane 76, a dielectric layer 78, and a signal layer 82. The dielectric layer, the solid metal plane, the AI-EBG plane, and the signal layer have been described in detail above. When used in mixed-signal systems, the stacking of structure B 60 substantially avoids signal integrity and EMI problems, and the AI-EBG plane 72 suppresses noise.

The signal layer 62 is positioned on the top of the dielectric layer 64. The solid metal plane 66 is positioned on the bottom of the dielectric layer 64. The dielectric layer 68 is positioned on the bottom of the solid metal plane 66. The AI-EBG plane 72 is positioned on the bottom of the dielectric layer 68. The dielectric layer 74 is positioned on the bottom of the AI-EBG plane 72. The solid metal plane 76 is positioned on the bottom of the dielectric layer 74. The dielectric layer 78 is positioned on the bottom of the solid metal plane 76. The signal layer 82 is positioned on the bottom of the dielectric layer 78.

Each layer or plane can be a ground plane or a power plane, and the selection of the type of layer or plane can be determined based, at least in part, on the product that the AI-EBG structure is incorporated into and the desired characteristics of the AI-EBG structure.

FIG. 4C illustrates structure C 90 having a signal layer 92, a dielectric layer 94, a solid metal plane 96, a dielectric layer 98, a AI-EBG plane 102, a dielectric layer 104, a solid metal plane 106, a dielectric layer 108, a signal layer 112, a dielectric layer 114, a solid metal plane 116, a dielectric layer 118, a AI-EBG plane 122, a dielectric layer 124, a solid metal plane 126, a dielectric layer 128, and a signal layer 132. The dielectric layer, the solid metal plane, the AI-EBG plane, and the signal layer have been described in detail above. The stacking structure C 90 substantially avoids signal integrity and EMI problems, while the AI-EBG plane suppresses noise, when used in mixed-signal systems.

The signal layer 92 is positioned on the top of the dielectric layer 94. The solid metal plane 96 is positioned on the bottom of the dielectric layer 94. The dielectric layer 98 is positioned on the bottom of the solid metal plane 96. The AI-EBG plane 102 is positioned on the bottom of the dielectric layer 98. The dielectric layer 104 is positioned on the bottom of the AI-EBG plane 102. The solid metal plane 106 is positioned on the bottom of the dielectric layer 104. The dielectric layer 108 is positioned on the bottom of the solid metal plane 106. The signal layer 112 is positioned on the bottom of the dielectric layer 108. The dielectric layer 114 is positioned on the bottom of the signal layer 112. The solid metal plane 116 is positioned on the bottom of the dielectric layer 114. The dielectric layer 118 is positioned on the bottom of the solid metal plane 116. The AI-EBG plane 122 is positioned on the bottom of the dielectric layer 108. The dielectric layer 124 is positioned on the bottom of the AI-EBG plane 122. The solid metal plane 126 is positioned on the bottom of the dielectric layer 124. The dielectric layer 128 is positioned on the bottom of the solid metal plane 126. The signal layer 132 is positioned on the bottom of the dielectric layer 128.

Each layer or plane can be a ground plane or a power plane, and the selection of the type of layer or plane can be determined based, at least in part, on the product that the AI-EBG structure is incorporated into and the desired characteristics of the AI-EBG structure.

Figure 5:
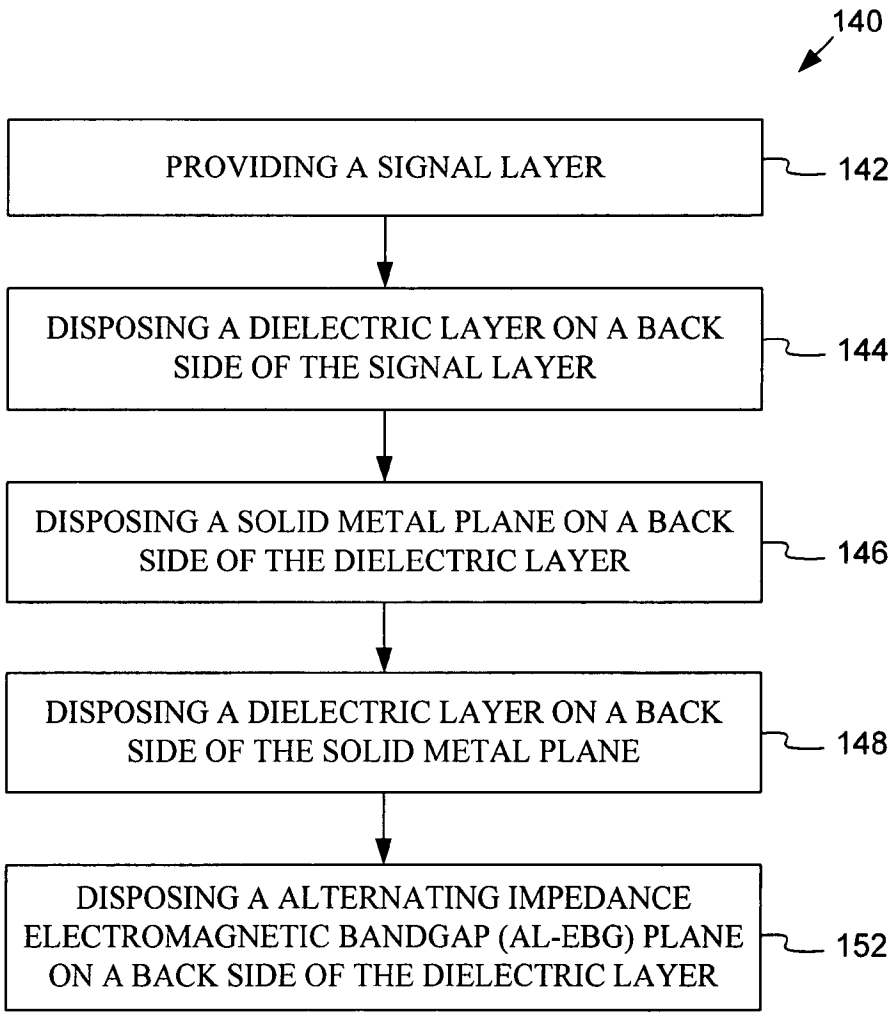
FIG. 5 illustrates a flow chart of a method of fabricating the structure in FIG. 4A.

FIG. 5 illustrates a flow diagram 140 of the fabrication of the AI-EBG structure 40 in FIG. 4A. It should be noted that the steps of the flow diagram could be conducted in a different order. Also, portions of the AI-EBG structure 40 can be formed separately and then combined. For example, the signal layer 42, dielectric layer 44, and solid metal plane 46 can be formed separately from the dielectric layer 48 and the AI-EBG plane 52, and then these portions combined. It should be noted that AI-EBG structures 60 and 90 could be fabricated in a similar manner.

In block 142, a signal layer 42 is provided. In block 144, a dielectric layer 44 is disposed on the backside of the signal layer 42. In block 146, a solid metal plane 46 is disposed on the backside of the dielectric layer 44. In block 148, a dielectric layer 48 is disposed on the backside of the solid metal plane 46. In block 152, an AI-EBG plane is disposed on the back of the dielectric layer 48.

It should be noted that ratios, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

It should be emphasized that the above-described embodiments of the present disclosure are merely possible examples of implementations, merely set forth for a clear understanding of the principles of the disclosure. For example, the systems having the AI-EBG structures can be fabricated of multiple materials. Therefore, many variations and modifications may be made to the above-described embodiment(s) of the disclosure without departing substantially from the spirit and principles of the disclosure. All such modifications and variations are intended to be included herein within the scope of this disclosure and protected by the following claims.

Now having described the embodiments of the systems having the AI-EBG structures in general, example 1 describes some embodiments of the AI-EBG structure that is described in J. Choi, V. Govind, M. Swaminathan, K. Bharath, D. Chung, D. Kam, J. Kim, "Noise suppression and isolation in mixed-signal systems using alternating impedance electromagnetic bandgap (AI-EBG)," submitted to *IEEE Transactions on Electromagnetic Compatibility*, September 2005.

While embodiments of systems having the AI-EBG structures are described in connection with Example 1 and the corresponding text and figures, there is no intent to limit embodiments of the structures to these descriptions. On the contrary, the intent is to cover all alternatives, modifications, and equivalents included within the spirit and scope of embodiments of the present disclosure.

EXAMPLE 1

In this Example, a two-layer AI-EBG structure has been discussed. Along with reducing the layer count, this structure does not require any blind vias. Moreover, this structure provides better isolation level as compared to other EBG structures that have been proposed so far. In this Example, the proposed AI-EBG structure has been investigated with a mixed-signal test vehicle to quantify the isolation levels that are achievable.

Noise Coupling in Mixed-Signal Systems

Figure 6:
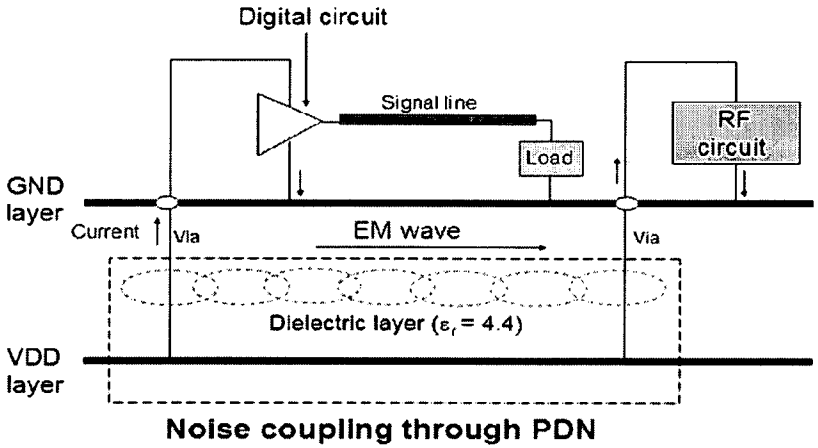
FIG. 6 illustrates noise coupling in a mixed-signal system.

With the evolution of technologies, mixed-signal system integration is becoming necessary for combining heterogeneous functions such as high-speed processors, radio frequency (RF) circuits, memory, microelectromechanical systems (MEMS), sensors, and optoelectronic devices. This kind of integration is necessary for enabling convergent Microsystems that support communication and computing capabilities in a tightly integrated module. A major bottleneck with such heterogeneous integration is the noise coupling between the dissimilar blocks constituting the system. As an example, the noise generated by high-speed digital circuits can couple through the power distribution network (PDN) and transfer to sensitive RF circuits, completely destroying the functionality of noise-sensitive RF circuits. FIG. 6 shows the noise coupling mechanism due to electromagnetic (EM) waves in a mixed-signal system including RF and digital circuits. The time-varying current flowing through a via due to the switching of digital circuits can cause the excitation of EM waves. Since a power/ground plane pair used to supply power to the switching circuits behaves as a parallel-plate waveguide at high frequencies, the EM wave can propagate between the power/ground plane pair and couple to the RF circuit, causing the failure of the RF circuit. To prevent this noise coupling, traditional isolation techniques have used split planes with multiple power supplies, split planes and ferrite beads with a single power supply, and split power islands.

All these methods have two fundamental problems, namely, a) they provide poor isolation in the −20 dB to −60 dB range above 1 GHz and b) they provide narrow band capability. Hence, the development of better noise isolation methods for the integration of digital and RF functions is necessary. One method for achieving high isolation over broad frequency range is through the use of electromagnetic band gap (EBG) structures. EBG structures are periodic structures that suppress wave propagation in certain frequency bands while allowing it in others. For power delivery network, EBG structures can be constructed by patterning one of the power and ground planes. In this Example, a novel EBG structure based on the alternating impedance (AI-EBG) concept is discussed for use in power delivery networks.

Design of AI-EBG Structure

Figure 8:
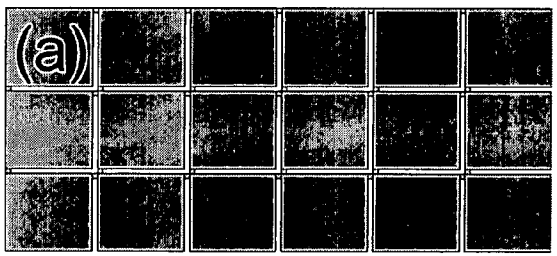
FIG. 8 illustrates: (a) a schematic of a periodic pattern in one of power and ground planes in the AI-EBG structure, and (b) a unit cell in a periodic pattern in one of power and ground planes in the AI-EBG structure.
Figure 8:
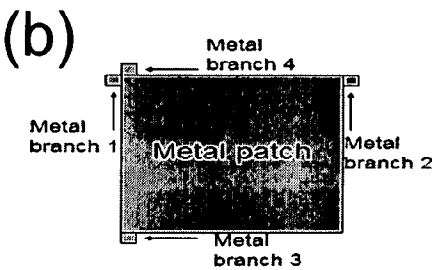
Figure 7:
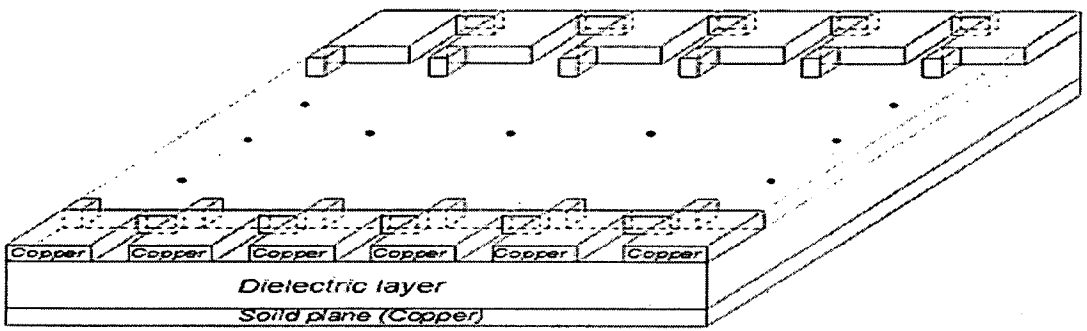
FIG. 7 illustrates a schematic of an embodiment of a three-dimensional (3-D) structure view of the AI-EBG structure.

The AI-EBG structure is a metallo-dielectric EBG structure that includes two metal layers separated by a thin dielectric material, as shown in FIG. 7. In the AI-EBG structure, one metal layer has only a periodic pattern that is a two-dimensional (2-D) rectangular lattice with each element including a metal patch with four connecting metal branches, as shown in FIG. 8(*a*).

This EBG structure can be realized with metal patches etched in the power plane (or in the ground plane depending on design) connected by metal branches to form a distributed LC network (where L is inductance and C is capacitance). In this structure, a metal branch introduces additional inductance while the metal patch and the corresponding solid plane form the capacitance. The unit cell of this EBG structure is shown in FIG. 8(*b*). The location of metal branches on edges of the metal patch was optimized to ensure maximum wave destructive interference, which results in excellent isolation in the stopband frequency range. It is important to note that the shape of the metal patch and branch can be shapes including, but not limited to, a square, or a rectangle. FIG. 8(*a*) represents one layer of the plane pair where the other layer (not shown) is a solid plane.

The EBG structure formed in FIG. 7 does not require blind vias and the dielectric thickness can be very thin (1 mil~4 mils), which results in a low-cost process. Hence, the AI-EBG structure has the advantage of being simple and can be easily designed and fabricated using standard printed circuit board (PCB) processes without the need for vias and only using two metal layers, as compared to the mushroom-type EBG structure, which requires three metal layers and blind vias.

Equivalent Circuit Representation of AI-EBG Structure

Figure 9:
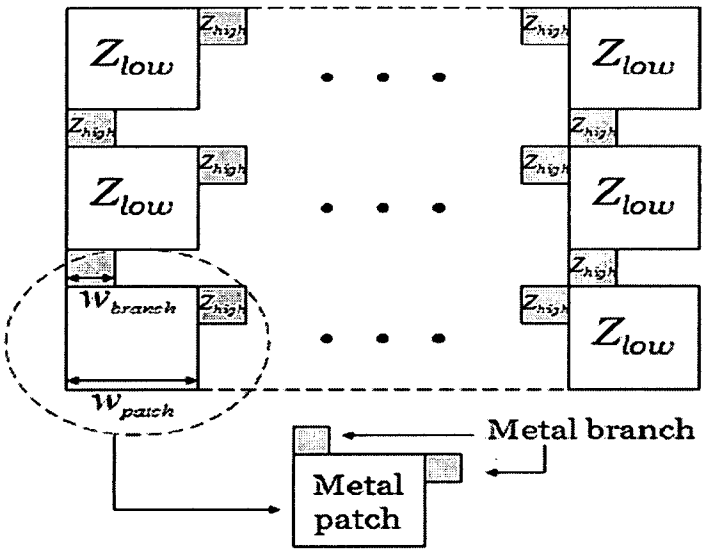
FIG. 9 illustrates an embodiment of the AI-EBG structure with alternating impedance.

The EBG structure presented in this Example can be called as the alternating impedance EBG (AI-EBG) since it includes alternating sections of high and low characteristic impedances, as shown in FIG. 9. The EBG structure in FIG. 7 is a two-dimensional (2-D) parallel-plate waveguide (or 2-D transmission line) with alternating perturbation of its characteristic impedance. The metal patch on the top layer and the corresponding solid plane on the bottom layer can be represented as a parallel-plate waveguide having low characteristic impedance, while the metal branch and the corresponding solid plane pair can be treated as a parallel-plate waveguide having high characteristic impedance. This is because the characteristic impedance in a parallel-plate waveguide for a TEM mode (dominant mode in plane pairs with thin dielectrics), is given by the following formula:

$$Z_o = \frac{\eta d}{w} = \sqrt{\frac{L}{C}} \tag{1}$$

where η is intrinsic impedance of the dielectric, d is the dielectric thickness, w is the width of the metal, L and C are inductance and capacitance per unit length. Since $w_{patch} > w_{branch}$ and characteristic impedances are inversely proportional to w, $Z_o$ of the metal patch is lower than $Z_o$ of the metal branch. Due to this impedance perturbation, wave propagation can be suppressed in certain frequency bands.

Figure 10:
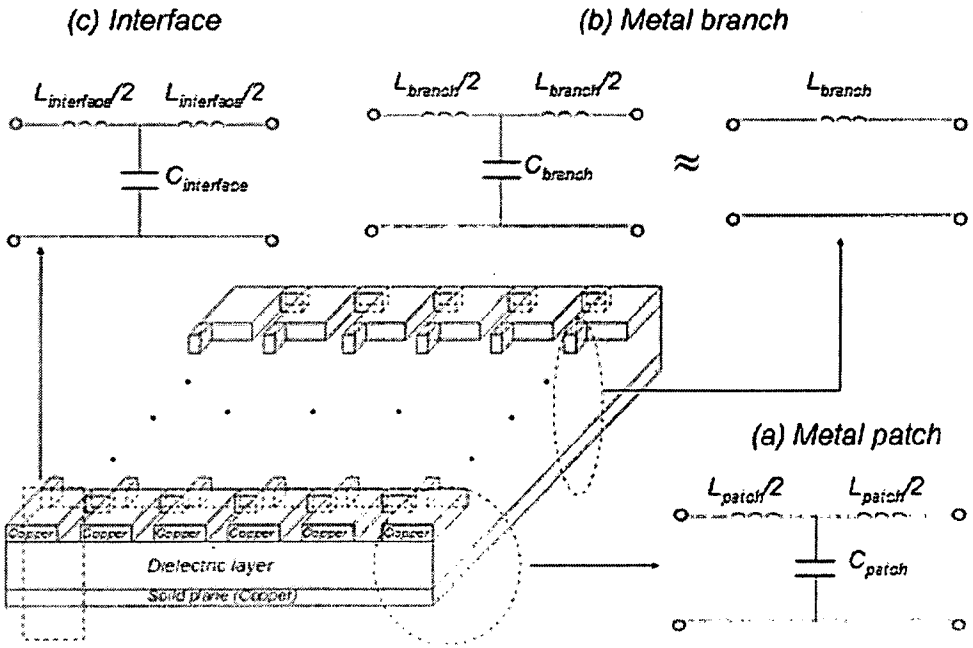
FIG. 10 illustrates one-dimensional (1-D) equivalent circuits for 3 parts of an AI-EBG structure. In (a) a 1-D equivalent circuit for the metal patch including FR4 and the corresponding metal part of the other solid plane is illustrated. In (b) a 1-D equivalent circuit for the metal branch part including FR4 and the corresponding metal part of the other solid plane is illustrated. In (c) a 1-D equivalent circuit for the interface between a metal patch and a metal branch is illustrated.

The AI-EBG dispersion characteristics can also be explained using filter theory. FIG. 10 shows the three-dimensional (3-D) schematic of the EBG structure with 3 equivalent circuits described. FIG. 10(*a*) shows the one-dimensional (1-D) T-type equivalent circuit of the metal patch including dielectric and the corresponding solid plane and FIG. 10(*b*) shows the 1-D equivalent circuit of the metal branch including dielectric and the corresponding solid plane. In this figure, $C_{branch}$ is very small and can be neglected due to the size of the metal branch. In addition to the LC elements, small parasitic reactances at the interface between the metal patch and branch exist, as shown in FIG. 10(*c*) due to discontinuities caused by the change in width. From FIG. 10, it is clear that the resulting two-dimensional LC network representing AI-EBG structure is a low-pass filter (LPF), which has been verified through simulations and measurements in the following sections.

Propagation Characteristics of AI-EBG Structure

Figure 11:
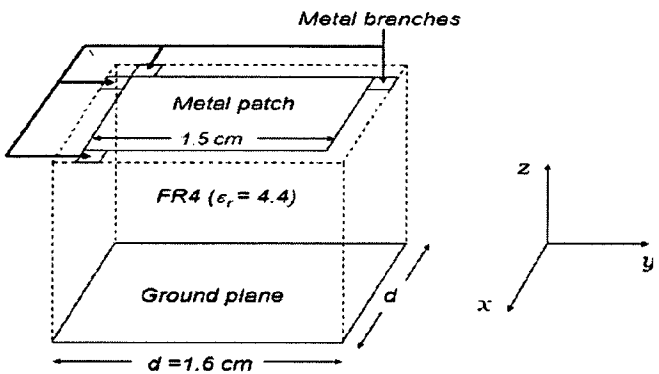
FIG. 11 illustrates a two-dimensional (2-D) unit cell of the AI-EBG structure.

To understand the dispersion characteristics, the transmission line network (TLN) method has been used in this Example. The TLN approach is based on standard periodic analysis for one dimensional symmetric unit cells. FIG. 11 shows the unit cell for the two-dimensional AI-EBG structure. It includes two metal layers with a metal patch on the top layer, four metal branches on the top layer, and a ground plane on the bottom.

For clarity, the structure is assumed periodic along the y direction with perfect magnetic walls along the x directed boundaries. The structure is assumed infinite along y direction with wave propagation along the y axis. This enables the modeling and visualization using TLN analysis, while retaining sufficient generality to describe the unique dispersion characteristics of the AI-EBG structure.

Figure 12:
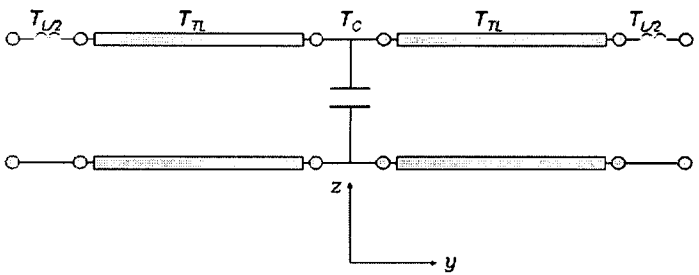
FIG. 12 illustrates an equivalent TL circuit for the unit cell in FIG. 11 in the y-direction.

Using the equivalent transmission line circuit in FIG. 12, the transfer matrix for the unit cell can be written as:

$$T_{Unit_Cell(B2)} = T_{L/2} T_{TL} T_C T_{TL} T_{L/2} \tag{2}$$

The first and fifth matrix in (2), $T_{L/2}$, represents the equivalent series inductance due to metal branch on the edge of metal patch. The value of the series inductance is halved (L/2) to account for symmetry of the structure. The second and fourth matrix, $T_{TL}$, represents the transfer matrix for a uniform section of transmission line of length d/2. The third matrix, $T_C$, represents the equivalent shunt capacitance between the metal patch and the corresponding ground plane.

Using ABCD matrix, $T_{Unit_Cell(B2)}$ can be expressed as $$T_{\text{Unit_Cell}(BZ)} = \begin{bmatrix} 1 & \frac{Z_{branch}}{2} \\ 0 & 1 \end{bmatrix} \begin{bmatrix} \cos\frac{kd}{2} & jZ_0\sin\frac{kd}{2} \\ jY_0\sin\frac{kd}{2} & \cos\frac{kd}{2} \end{bmatrix} \begin{bmatrix} 1 & 0 \\ Y_{patch} & 1 \end{bmatrix} \begin{bmatrix} \cos\frac{kd}{2} & jZ_0\sin\frac{kd}{2} \\ jY_0\sin\frac{kd}{2} & \cos\frac{kd}{2} \end{bmatrix} \begin{bmatrix} 1 & \frac{Z_{branch}}{2} \\ 0 & 1 \end{bmatrix} \quad (3)$$

where $Z_{branch}=j\omega L_{branch}$, kd=phase delay of transmission line segment, $k=2\pi f\sqrt{\mu\epsilon}$, d is the length of a unit cell, $Y_{patch}=j\omega C_{patch}$, $Z_o$ is the characteristic impedance of the transmission line segment, $Y_o$ is the characteristic admittance of the transmission line segment, ω is the angular frequency given by $\omega=2\pi f$, f is the frequency and μ and ϵ are the permeability and permittivity of the dielectric material.

After some calculations, (3) becomes:

$$T_{\text{Unit_Cell}(BZ)} = \begin{bmatrix} A_{BZ} & B_{BZ} \\ C_{BZ} & D_{BZ} \end{bmatrix} \quad (4)$$

where $$A_{BZ} = \cos^2\frac{kd}{2}\left(1+\frac{ZY}{2}\right) - Z_oY_o\sin^2\frac{kd}{2} + j\sin\frac{kd}{2}\cos\frac{kd}{2}(ZY_o + Z_oY),$$

$$B_{BZ} = \cos^2\frac{kd}{2}\left(1+\frac{Z^2Y}{4}\right) - \sin^2\frac{kd}{2}(ZZ_oY_o + Z_o^2Y) + j\sin\frac{kd}{2}\cos\frac{kd}{2}\left(\frac{Z^2Y}{2} + Z_oZY + 2Z_o\right),$$

$$C_{BZ} = Y\cos^2\frac{kd}{2} + j2Y_o\sin^2\frac{kd}{2}\cos\frac{kd}{2},$$

$$D_{BZ} = \cos^2\frac{kd}{2}\left(1+\frac{ZY}{2}\right) - Z_oY_o\sin^2\frac{kd}{2} + j\sin\frac{kd}{2}\cos\frac{kd}{2}(ZY_o + Z_oY),$$

$$Z = Z_{branch} \text{ and } Y = Y_{patch}.$$

By combining the ABCD matrix of the Brillouin zone unit cell, $T_{Unit_Cell(B2)}$, with Floquet's theorem, which relates the voltage and current between the nth terminal (input and n+1th terminal (output of the unit cell) through $e^{-\gamma d}$, the following is $$\begin{bmatrix} V_n \\ I_n \end{bmatrix} = T_{\text{Unit_Cell}(BZ)} \begin{bmatrix} V_{n+1} \\ I_{n+1} \end{bmatrix} = \begin{bmatrix} A_{BZ} & B_{BZ} \\ C_{BZ} & D_{BZ} \end{bmatrix} = e^{\gamma d} \begin{bmatrix} V_{n+1} \\ I_{n+1} \end{bmatrix} \quad (5)$$

where $\gamma=\alpha+j\beta$ is the complex propagation constant, α is the attenuation constant, and β is the phase constant.

Based on a nontrivial solution for (5), the following analytic dispersion equation for the AI-EBG structure can be obtained as:

$$\cos\beta d = \frac{Z_{branch}Y_{patch}}{2}\cos^2\frac{kd}{2} + \cos kd + j\frac{\sin kd}{2}\left(\frac{Z_{branch}Y_0 + Z_0Y_{patch}}{Z_0Y_0}\right). \quad (6)$$

Figure 13:
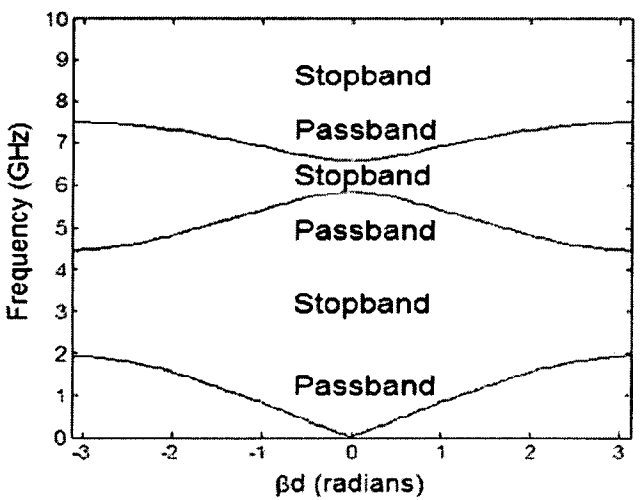
FIG. 13 illustrates a dispersion diagram for the unit cell of the AI-EBG structure in FIG. 11 using transmission line network (TLN) method.

FIG. 13 shows the dispersion diagram using (6) for the unit cell of the AI-EBG structure in FIG. 11. As shown in FIG. 13, the dispersion diagram includes layers of alternating passbands and stopbands. In this dispersion diagram, the first mode is a slow-wave TM mode that is tightly bound to the surface. It starts as a forward propagating TEM mode at very low frequency, and transits to a forward propagating TM surface wave. The group velocity (dω/dβ) of this mode is positive and its phase velocity (ω/β) is much less than the speed of light, which indicates that this mode is forward propagating as a slow-wave. The second mode is a backward mode since it has a negative group velocity. The third mode is a forward propagating TE mode. In the dispersion diagram, the AI-EBG structure, like other periodic structures, supports slow-wave propagation and has passband and stopband characteristics similar to those of filters.

Modeling of AI-EBG Structure

This section describes the modeling of the AI-EBG structure for extracting the S-parameters and computing voltage distributions. The full-wave EM solvers can be used to analyze EBG structures, but they are computationally expensive due to the grid size required. So, there is a need for efficient methods for modeling EBG structures with reasonable simulation time and good accuracy. The transmission matrix method (TMM) is a good candidate for analyzing the AI-EBG structure since it has been successfully applied to complex power delivery networks elsewhere. The good model to hardware correlation for a realistic PDN in packages and boards has been verified elsewhere.

Figure 14:
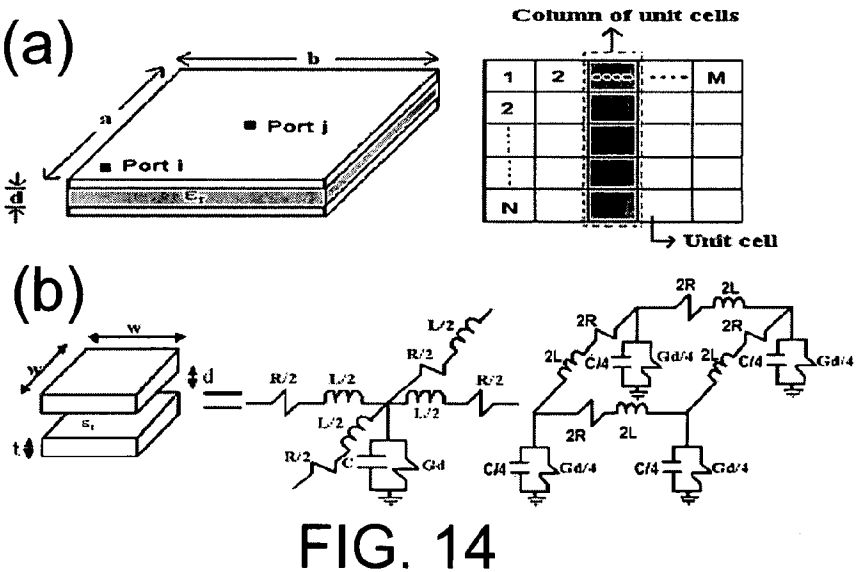
FIG. 14 illustrates: (a) a plane pair structure and (b) a unit cell and equivalent circuit (T and II models).

Power/ground planes can be divided into unit cells, as shown in FIG. 14(*a*), and represented using a lumped element model for each cell. The lumped element model parameters are computed from the physical structure. Each cell includes an equivalent circuit with R, L, C, and G components, as shown in FIG. 14(*b*) for a rectangular structure. Each unit cell can be represented using either a T or Π model, as shown in the FIG. 14(*b*). The equivalent circuit parameters for a unit cell can be derived from quasi-static models, provided the dielectric separation (d) is much less than the metal dimensions (a, b), which is true for a power/ground pair.

From the lateral dimension of a unit cell (w), separation between planes (d), dielectric constant (ϵ), loss tangent of dielectric (tan (δ), metal thickness (t), and metal conductivity ($\sigma_c$), the equivalent circuit parameters of a unit cell can be computed from the following equations:

$$C = \varepsilon_o\varepsilon_r\frac{w^2}{d},\ L = \mu_o d,\ R_{DC} = \frac{2}{\sigma_c t},\ R_{AC} = 2\sqrt{\frac{\pi f\mu_o}{\sigma_c}}(1+j),\ \text{and } G_d = \omega C\tan(\delta). \quad (7)$$

In the above equation, $\epsilon_o$ is the permittivity of free space, $\mu_o$ is the permittivity of free space, and $\epsilon_r$ is the relative permittivity of the dielectric. The parameter $R_{DC}$ is the resistance of both the power and ground planes for a steady DC current, where the planes are assumed to be of uniform cross-section. The AC resistance $R_{AC}$ accounts for the skin effect on both conductors. The shunt conductance $G_d$ represents the dielectric loss in the material between planes.

In order to increase accuracy of the simulation, it is necessary to extend the basic model described above with circuit models for edge and gap effects. It is critical to model these effects to obtain accurate bandwidth and isolation levels in S parameter simulation. Edge effects can be modeled by adding an LC network to all the edges of the AI-EBG structure to model the fringing fields. The total capacitance ($C_T$) including fringing capacitance ($C_f$) for the edge cells of the AI-EBG structure can be calculated by employing the empirical formula for the per unit length capacitance of a microstrip line given by:

$$C_T = \varepsilon_{eff}\left[\left(\frac{W}{d}\right) + 0.77 + 1.06\left(\frac{W}{d}\right)^{0.25} + 1.06\left(\frac{t}{h}\right)^{0.5}\right], \quad (8)$$

where $\varepsilon_{eff} = \frac{\varepsilon_r + 1}{2} + \frac{\varepsilon_r - 1}{2}\frac{1}{\sqrt{1 + \frac{12d}{W}}}$ is the effective dielectric constant, W is the metal line width, d is the dielectric thickness and t is the metal thickness. In (8), the first term is for the parallel-plate capacitance, and the other three terms in (8) accounts for fringing capacitance. In order to maintain a physical phase velocity, the per unit length inductance must be reduced from the parallel-plate inductance in accordance with $$\sqrt{LC} = \sqrt{\mu\epsilon}. \quad (9)$$

Figure 15:
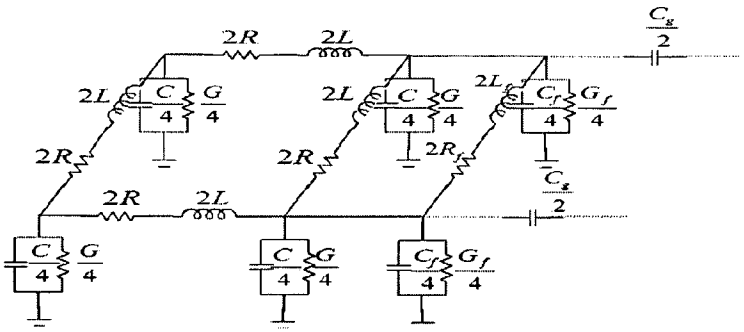
FIG. 15 illustrates an equivalent Π circuit for the unit cell including fringing and gap effects.

This reduction is accomplished by adding an inductance between two adjacent nodes on the edge of the AI-EBG structure. Gap coupling can be modeled by including a gap capacitance, $C_g$, between nodes across a gap in two metal patches in the AI-EBG structure. The gap capacitance was extracted from a 2-D solver such as Ansoft Maxwell™. For example, the gap capacitance per unit length extracted from Ansoft Maxwell™ for the AI-EBG structure in FIG. 16(*a*) was 5.5 pF/m. FIG. 15 shows the updated equivalent Π circuit for the unit cell including fringing and gap capacitances. It is important to note that the locations of the fringing and gap capacitances in the unit cell depend on the location of the unit cell in the AI-EBG structure. Once the unit cell equivalent circuits are available, these are converted to ABCD matrices and efficiently solved using TMM.

Figure 16:
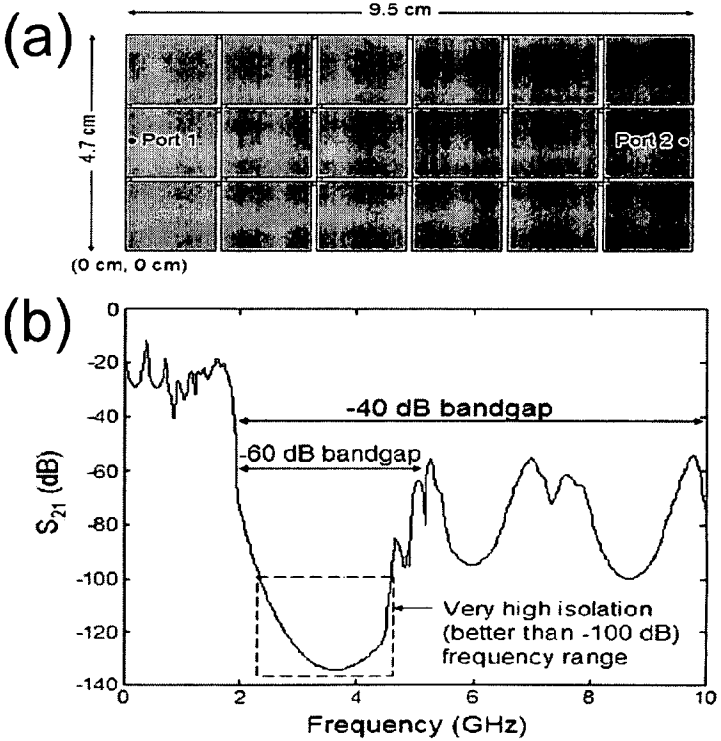
FIG. 16 illustrates: (a) a schematic of the simulated AI-EBG structure and (b) simulated results of transmission coefficient ($S_{21}$) for the AI-EBG structure in (a).

The test structure used was a two metal layer board with size 9.5 cm by 4.7 cm in size. In this example, the size of the metal patch was 1.5 cm×1.5 cm and the size of the metal branch was 0.1 cm×0.1 cm. The dielectric material of the board was FR4 with a relative permittivity, $\epsilon_r$=4.4, the conductor was copper with conductivity, $\sigma_c$=5.8×10$^7$ S/m, and dielectric loss tangent was tan (δ)=0.02. The copper thickness for power plane and ground plane was 35 μm and dielectric thickness was 2 mils. A unit cell size of 0.1 cm×0.1 cm, which corresponds to an electrical size of λ/14.3 at 10 GHz, was used for approximating the structure. Port 1 was placed at (0.1 cm, 2.4 cm) and port 2 was located at (9.4 cm, 2.4 cm) with the origin (0 cm, 0 cm) lying at the bottom left corner of the structure, as shown in FIG. 16(*a*). The transmission coefficient between two ports, $S_{21}$, was computed by TMM and is shown in FIG. 16(*b*). This result shows an excellent stopband floor (−120 dB) and broad stopband (over 8 GHz for −40 dB bandgap). This simulation result is well correlated with the dispersion results in FIG. 13.

Figure 17:
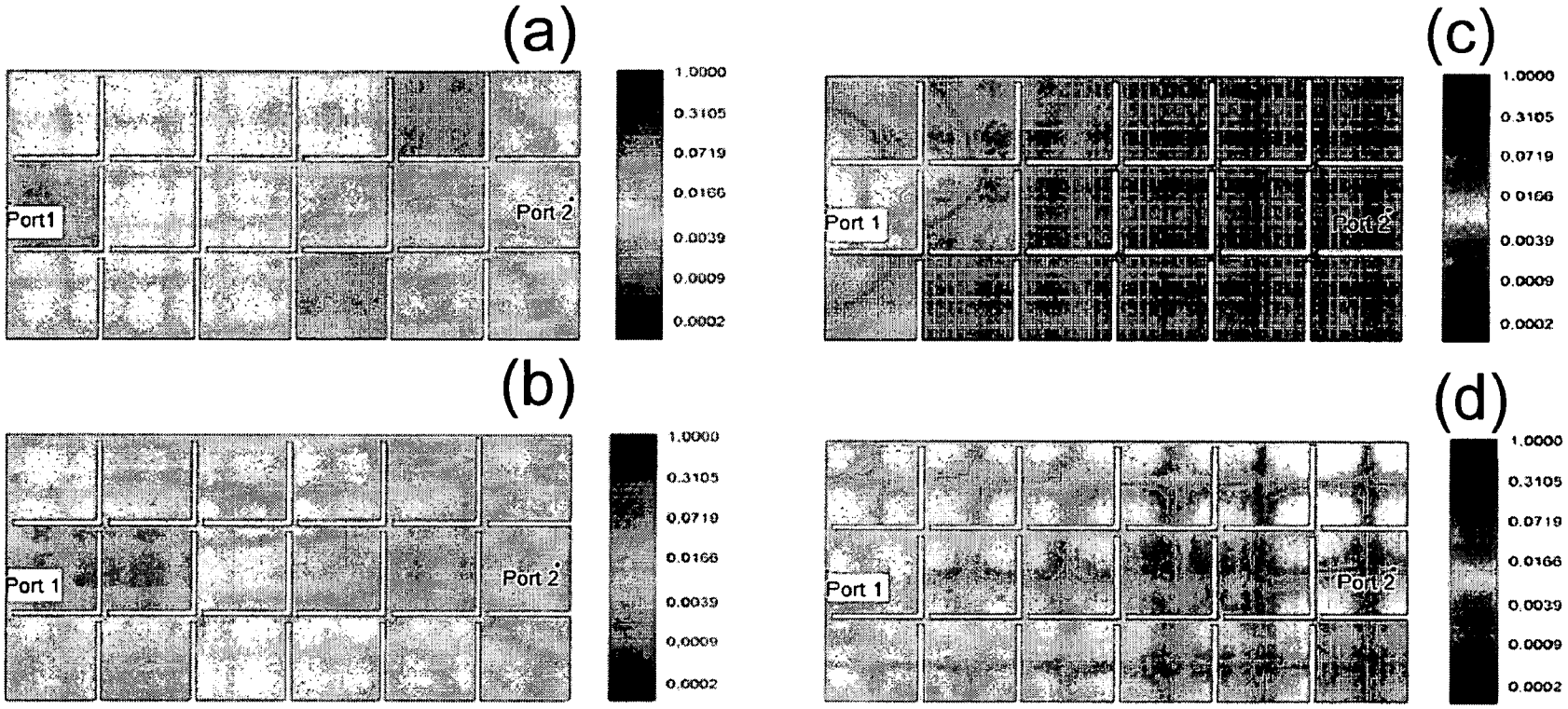
FIG. 17 illustrates simulated voltage magnitude distributions on the AI-EBG structure at different frequencies: (a) At 500 MHz. (b) At 1.5 GHz. (c) At 4 GHz. (d) At 7 GHz.

TMM was also used to obtain voltage variation on the AI-EBG structure in FIG. 16(*a*). First, the transfer impedances from the input port to all locations on the power/ground planes were computed using TMM. Then, a 10 mA current source was applied between power and ground planes on the input port that is port 1 in FIG. 17(*a*) to obtain the voltage distribution across the AI-EBG structure. FIG. 17(*a-d*) are the simulated color scale voltage magnitude distributions on the AI-EBG structure at 500 MHz, 1.5 GHz, 4 GHz and 7 GHz. The voltage variation is represented by a color contrast in these figures. The unit in the color bars in FIG. 17 is [V]. Isolation is desirable between port 1 and port 2 in this example. FIG. 17(*a*) shows that the AI-EBG structure does not provide good isolation at 500 MHz since 500 MHz is a frequency in passband. FIG. 17(*b*) shows the voltage distribution on the AI-EBG structure at 1.5 GHz, which is still a frequency in passband. In contrast, a voltage distribution in FIG. 17(*c*) shows excellent isolation since voltage variation is observed only in few metal patches around the metal patch containing port 1. This frequency, 4 GHz, corresponds to around the stopband center frequency in the first stopband for the AI-EBG structure in FIG. 16. It is important to note that noise generated by the current source on the input port can not propagate to the metal patches in the fourth, fifth, sixth columns in the AI-EBG structure at 4 GHz, which means that noise generated by digital circuits can not propagate to the RF circuits located at port 2 in FIG. 16(*a*). Finally, voltage variation across the whole AI-EBG structure is again observed at 7 GHz, as can be seen in FIG. 17(*d*), which represents the passband.

Model to Hardware Correlation

Figure 18:
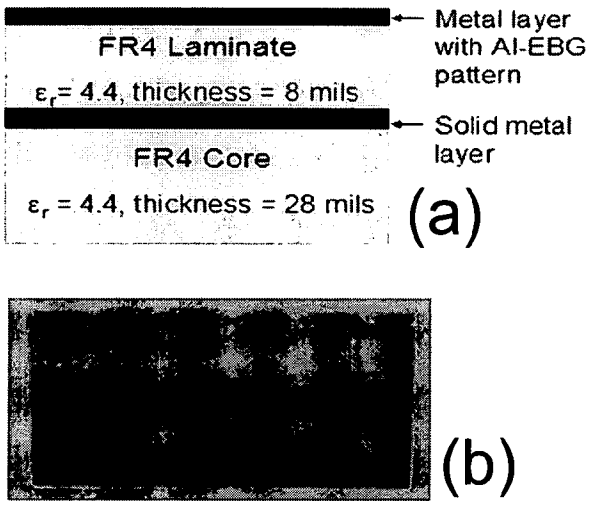
FIG. 18 illustrates the fabrication of AI-EBG structure. In (a) a cross section of fabricated AI-EBG structure is illustrated and in (b) a photo of a fabricated AI-EBG structure is shown.

To verify the simulated results, the AI-EBG structures discussed in this Example were fabricated using standard PCB processes. FIG. 18(*a*) shows the cross section of the fabricated structure. The top layer is a metal layer with AI-EBG pattern, and the second metal layer is a continuous solid plane. The dielectric material between these two metal layers is FR4 with a relative permittivity, $\epsilon_r$=4.4, the conductor is copper with conductivity, $\sigma_c$=5.8×10$^7$ S/m, and the dielectric loss tangent is tan (δ)=0.02. The bottom layer is a FR4 core layer for mechanical support.

Figure 19:
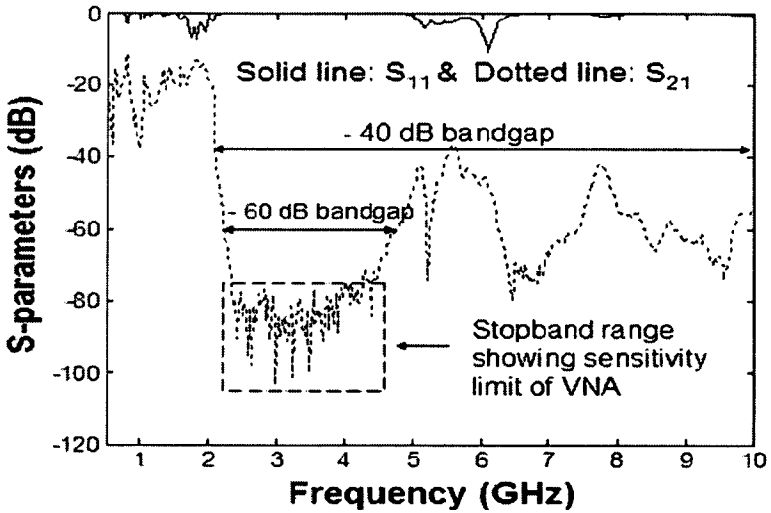
FIG. 19 illustrates measured S-parameters of the AI-EBG structure.
Figure 20:
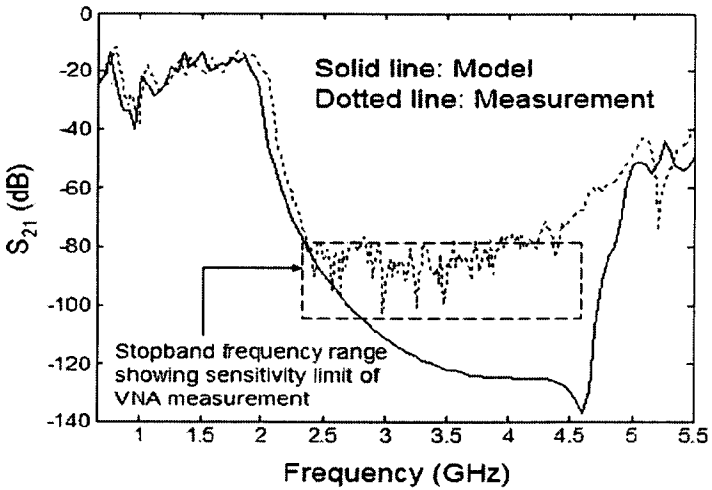
FIG. 20 illustrates a model to hardware correlation for the AI-EBG structure.

The S-parameter measurements were carried out using an Agilent 8720 ES vector network analyzer (VNA). FIG. 19 shows S-parameter results for one of the fabricated AI-EBG structures. In this case, the size of the metal patch was 1.5 cm×1.5 cm, and the size of the metal branch was 0.3 mm×0.3 mm. The entire structure size was 9.15 cm×4.56 cm. The measured $S_{21}$ shows a very deep and wide bandgap (over 8 GHz for −40 dB bandgap), and $S_{21}$ reached the sensitivity limit (−80 dB~−100 dB) of the VNA used in the frequency range from 2.2 GHz to 4.5 GHz. The modeling results were compared with the measurement result in FIG. 20, which shows reasonable agreement. The discrepancy between modeling and measurement is due to the sensitivity limit of the VNA in the stopband.

Noise Suppression and Isolation in Mixed-Signal System

In this section, the design, fabrication, and measurement of mixed-signal systems containing the AI-EBG structure in the power delivery network has been demonstrated. The results have been compared to a similar system with a regular power delivery network.

Figure 21:
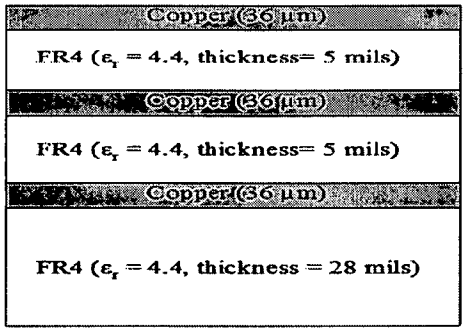
FIG. 21 illustrates a cross section of the fabricated mixed-signal systems.
Figure 22:
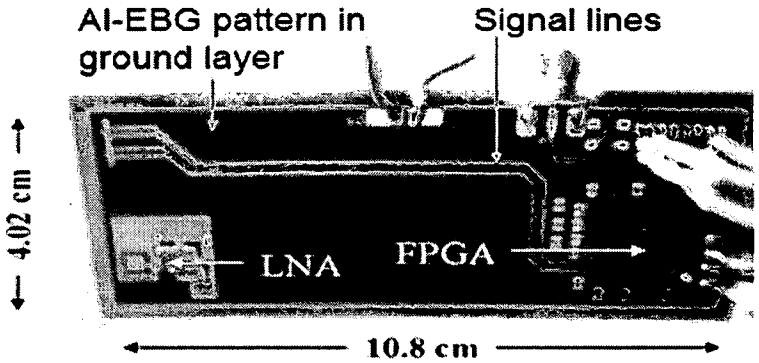
FIG. 22 illustrates a photo of the mixed-signal system containing the AI-EBG structure.
Figure 23:
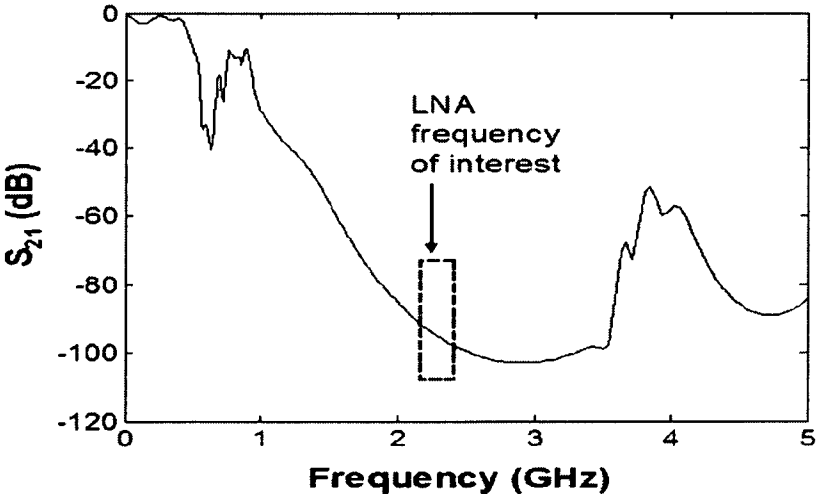
FIG. 23 illustrates a simulated transmission coefficient ($S_{21}$) between the LNA and FPGA in PDN with the AI-EBG structure.

Design and Fabrication: To verify the use of the AI-EBG based scheme for mixed-signal noise suppression, a test vehicle containing an FPGA driving a 300 MHz bus with an integrated low noise amplifier (LNA) operating at 2.13 GHz was designed and fabricated on an FR4 based substrate. FIG. 21 shows the cross section of the fabricated mixed-signal test vehicle. The board is a three metal layer PCB that is 10.8 cm by 4.02 cm. The first metal layer is a signal layer, the second metal layer is a ground layer (Gnd), and the third metal layer is a power layer (Vdd). The AI-EBG structure was located on the ground layer in the test vehicle. The dielectric material in the PCB was FR4 with a relative permittivity, $\epsilon_r$=4.4 and dielectric loss tangent tan (δ)=0.02. The metallization used was copper with conductivity, $\sigma$=5.8×$10^7$ S/m. The dielectric thickness between metal layers was 5 mils, with a bottom dielectric layer thickness of 28 mils. The bottom dielectric layer was used for mechanical support. FIG. 22 shows the photograph of the fabricated mixed-signal system containing the AI-EBG structure. The LNA was used as the noise sensor since it is the most sensitive device in an RF receiver. Noise generated in the FPGA couples to the LNA through the power distribution network. In the fabricated test vehicle, the size of the metal patch and metal branch used in the EBG structure was 2 cm×2 cm and 0.2 mm×0.2 mm, respectively. FIG. 23 shows the transmission coefficient ($S_{21}$) between FPGA and LNA, which was simulated using transmission matrix method (TMM). In FIG. 23, $S_{21}$ shows a very deep stopband (~−100 dB), which is required to suppress harmonic noise peaks generated by the digital circuits in the FPGA.

Figure 24:
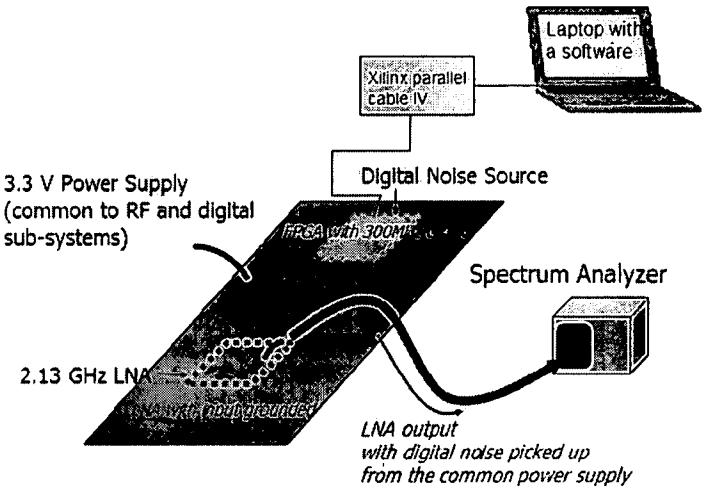
FIG. 24 illustrates a measurement set-up for noise measurements.

Measurements: FIG. 24 shows the measurement set-up for noise measurements. The AI-EBG-based common power distribution system was used for supplying power (3.3 V) to the RF and FPGA ICs. For comparison, a test vehicle similar to FIG. 22 was also fabricated without the AI-EBG structure.

In the measurements, the FPGA was programmed as four switching drivers using Xilinx software. The input terminal of the LNA was grounded to detect only noise from the FPGA through the PDN. The output terminal of the LNA was connected to a HP E4407B spectrum analyzer to observe noise from the FPGA.

Figure 25:
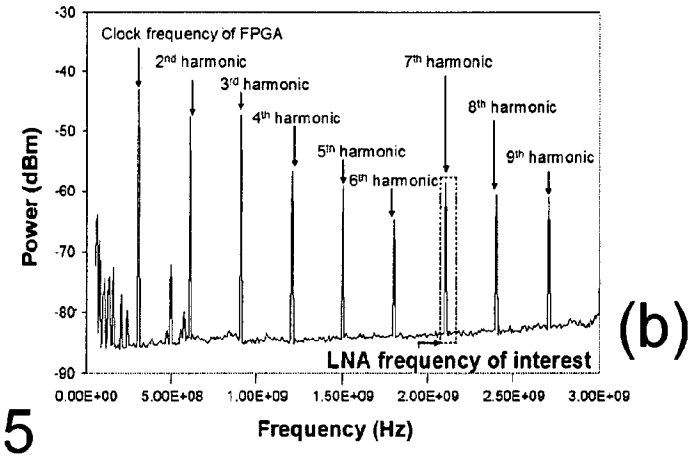
Figure 25:
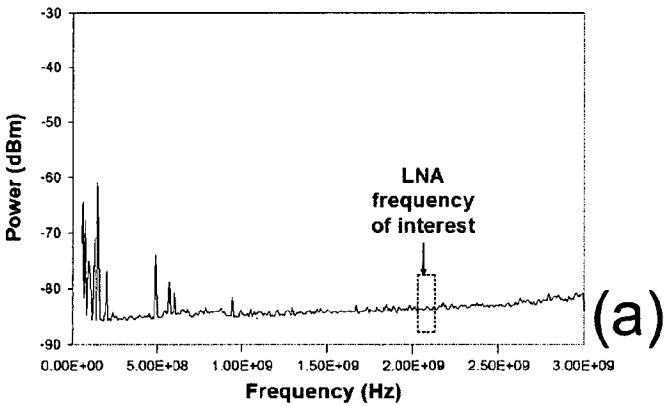
Figure 27:
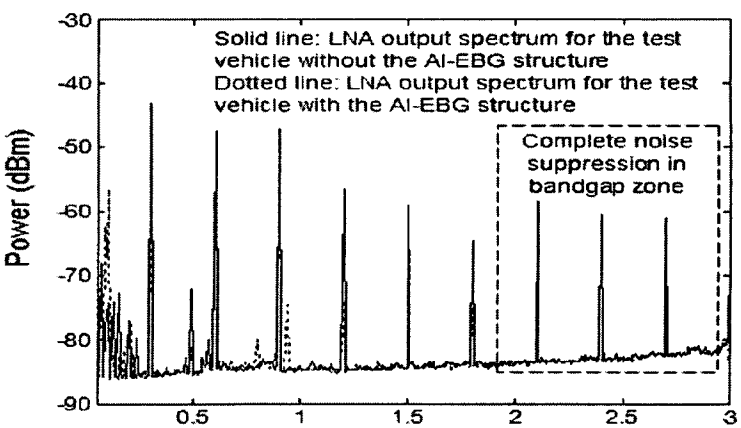
FIG. 27 illustrates a measured LNA output spectrum for the test vehicles with and without the AI-EBG structure.
Figure 26:
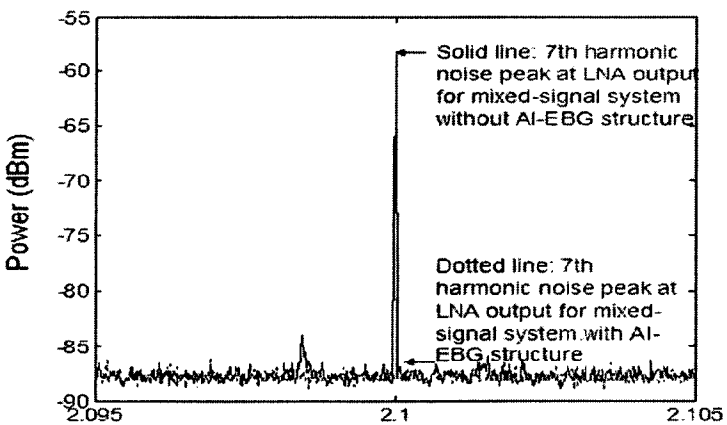
FIG. 26 illustrates measured $7^{th}$ harmonic noise peaks at 2.1 GHz for the test vehicle with and without the AI-EBG structure.

FIG. 25 shows the measured output spectrum of the LNA for the test vehicle without the AI-EBG structure. With the FPGA completely switched off, the output spectrum is clean and contains only low frequency noise, as shown in FIG. 25(*a*). However, when the FPGA is switched on with four switching drivers, the output spectrum exhibits a large number of noise components, as shown in FIG. 25(*b*), at the output of the LNA. As can be seen in FIG. 25(*b*), the noise components are harmonics of the FPGA clock frequency, which is at 300 MHz. In this diagram, the $7^{th}$ harmonic of the 300 MHz FPGA clock (at 2.1 GHz) lies close to the frequency of operation of the LNA, potentially degrading its performance. Hence, the $7^{th}$ harmonic noise peak should be suppressed for good LNA functionality. With the AI-EBG structure integrated into the ground plane, it is possible to suppress this harmonic noise peak. FIG. 26 shows the measured the LNA output spectrum around 2.1 GHz for the test vehicles with and without the AI-EBG structure. The $7^{th}$ harmonic noise peak at 2.1 GHz has been suppressed from −58 dBm to −88 dBm using the AI-EBG structure, which shows the ability of the AI-EBG structure for excellent noise suppression. It should be noted that −88 dBm is the noise floor in this measurement, which means that the $7^{th}$ harmonic noise peak due to the FPGA has been suppressed completely. FIG. 27 shows the measured LNA output spectrum from 50 MHz to 3 GHz for the test vehicles with and without the AI-EBG structure. The harmonic noise peaks from 2 GHz to 3 GHz have been suppressed completely using the AI-EBG structure. This frequency range (from 2 GHz to 3 GHz) corresponds to a stopband with −100 dB isolation level, as shown earlier in FIG. 23. As can be observed, the AI-EBG based scheme shows very efficient suppression of noise propagation from the digital circuits into RF circuits in integrated mixed-signal systems.

Signal Integrity Analysis

The power delivery network needs to function along with the signal lines for high-speed transmission. Since the power and ground planes carry the return currents for the signal transmission lines, the impact of AI-EBG structure in signal transmission needs to be analyzed, which is the focus of this section.

Time Domain Waveforms: Since the AI-EBG plane (i.e., the plane with the AI-EBG pattern) is used as a reference plane for signal lines in the stack-up shown in FIG. 21, the gaps in the AI-EBG structure function as discontinuities, causing degradation in the waveform. In a solid plane, return currents for high-speed transmission follow the path of least inductance. The lowest inductance return path lies directly under a signal line, which minimizes the loop area between the outgoing and returning current path.

Figure 28:
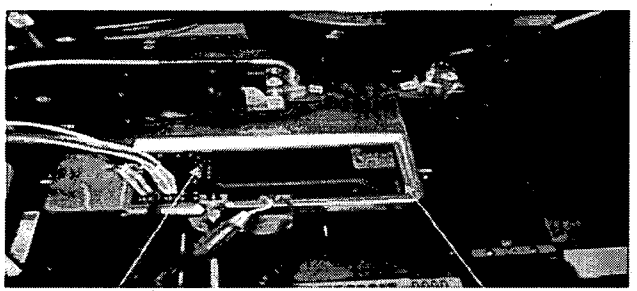
FIG. 28 illustrates a waveform measurement at two locations on the mixed-signal board.
Figure 29:
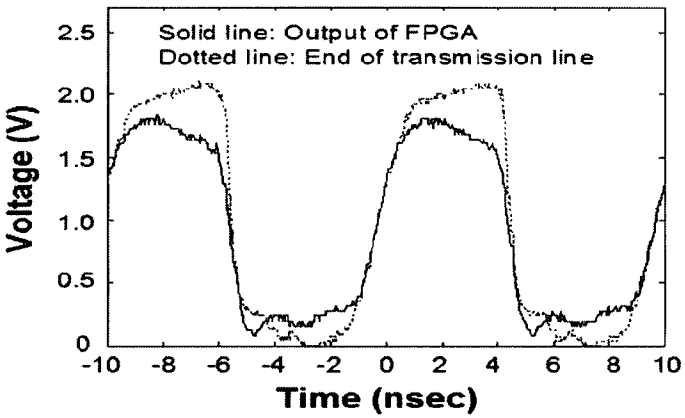
FIG. 29 illustrates measured waveforms at two different locations for signal integrity analysis.

To better understand signal quality, signal waveforms at the output of the FPGA and the far end of the transmission line were measured. These two locations are shown in FIG. 28. The signal from the FPGA propagates along a transmission line. FIG. 29 shows the measurement results at both locations at 100 MHz. In this figure, two signal waveforms were overlapped to compare differences between them. In this case, there is no serious signal integrity problem since slopes of signal waveforms are almost the same. But the signal waveform at the far end of the transmission line has larger amplitude as compared to the output of the FPGA.

Figure 30:
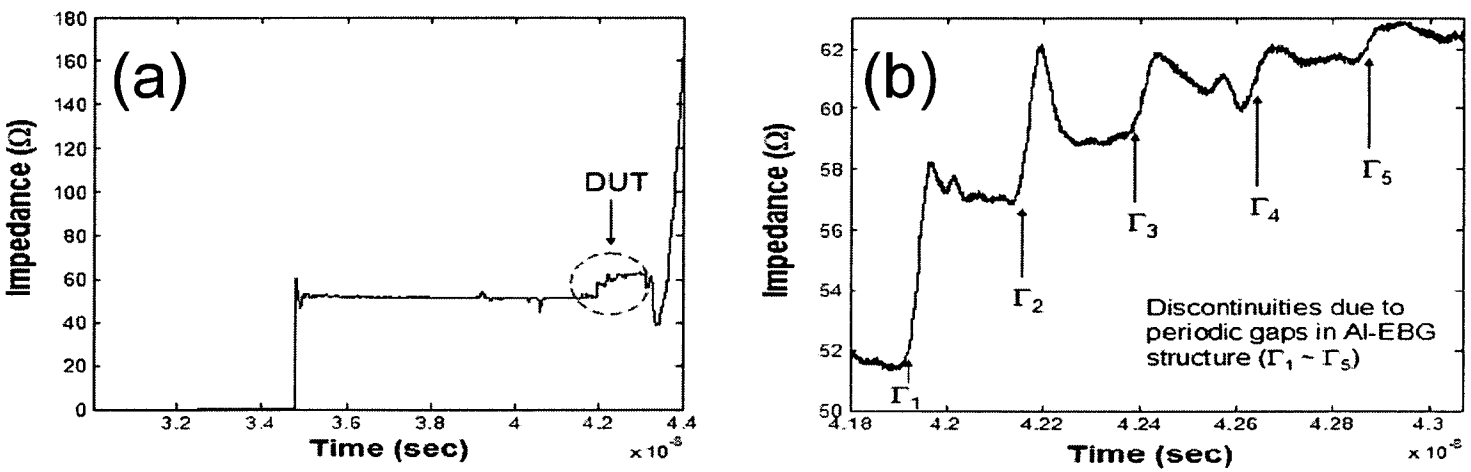
FIG. 30 illustrates a measured characteristic impedance profile of the first transmission line over the AI-EBG structure in the mixed-signal system. In (a) a characteristic impedance profile of the first transmission line over the AI-EBG structure is illustrated. In (b) a magnified characteristic impedance profile of the first transmission line over the AI-EBG structure is illustrated.

To investigate this phenomena, time domain reflectometry (TDR) measurements were performed to measure the characteristic impedance of the transmission line. In the TDR measurements, an injected voltage pulse propagates down the signal line, reflects off the discontinuity, and then returns to form a pulse on the oscilloscope. FIG. 30(*a*) shows the measured characteristic impedance profile for one of four transmission lines used in the test vehicle. For this measurement, cascade microprobes were used for probing the pad at the end of the first transmission line. FIG. 30(*b*) shows the magnified impedance profile for the device under test (DUT). In this figure, discontinuities in the impedance profile were observed. Each change in characteristic impedance causes the TDR trace to bump up or down to a new impedance level. Increasing impedance implies increased inductance, decreased capacitance, or both. Conversely, decreasing impedance implies increased capacitance, decreased inductance, or both. In FIG. 30(*b*), the first discontinuity is caused by the first gap in the EBG structure, which is an inductive discontinuity, as can be seen in FIG. 30. The inductive discontinuity is followed by a lower impedance transmission line due to the extra capacitance caused by the transmission line traversing a metal patch. Since an injected signal passes over five gaps before it arrives at the FPGA, there are five discontinuities along the signal path, as shown in FIG. 30(*b*).

Design Methodology: Since the AI-EBG plane is used as a reference plane for signal lines, it can cause signal integrity problems. The best solution for avoiding this signal integrity problem is to use a solid plane as a reference plane, rather than the AI-EBG plane. For example, in FIG. 21, the AI-EBG plane should be located on power layer ($3^{rd}$ metal layer) rather than on ground layer ($2^{nd}$ metal layer), which eliminates the signal degradation due to the EBG structure.

Figure 31:
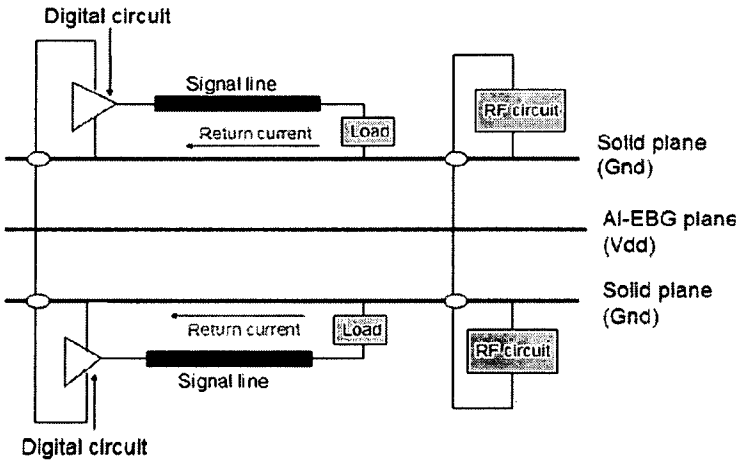
FIG. 31 illustrates an embodiment of a plane stack-up for avoiding possible problems related to signal integrity and EMI.

To prevent possible signal integrity as well as EMI problems, the plane stack-up in FIG. 31 is suggested. In FIG. 31, the first plane is the solid reference ground plane for the signal lines on the top signal layer, the second plane is the AI-EBG plane, and the third plane is the solid reference ground plane for the signal lines on the bottom signal layer.

In this stack-up, the AI-EBG plane is located between solid planes, which avoids possible problems associated with signal integrity because solid planes are used as reference planes for signal transmission lines. Since gaps in reference planes cause common mode currents of the transmission lines, the stack-up shown in FIG. 31 also avoids radiation from the AI-EBG structure. This has been confirmed through a combination of modeling and measurements in the next section.

Figure 32:
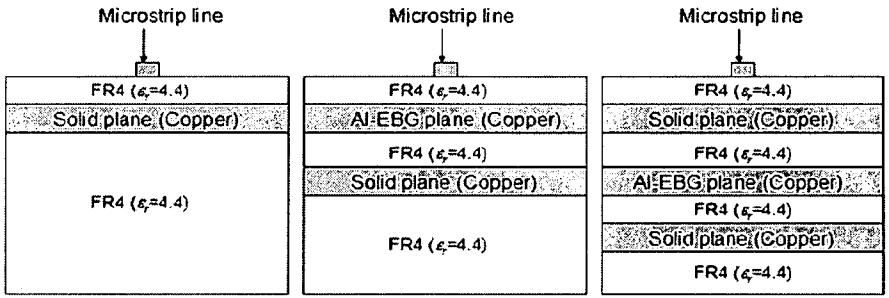
FIG. 32 illustrates a cross section of the three test vehicles: (a) test vehicle 1 is a microstrip line on a solid plane, (b) test vehicle 2 is a microstrip line on an AI-EBG structure, and (c) test vehicle 3 is a microstrip line on an embedded AI-EBG structure.
Figure 33:
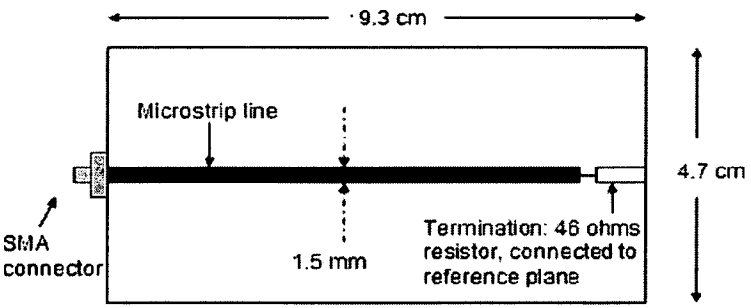
FIG. 33 illustrates a top view of the test vehicles.

Far Field Radiation Analysis: Three test vehicles were designed and fabricated for far field radiation analysis. The first test vehicle is a microstrip line on a solid plane, the second test vehicle is a microstrip line on an AI-EBG structure, and the third test vehicle is a microstrip line on an embedded AI-EBG structure. The third test vehicle was designed to suppress noise in mixed-signal systems without any EMI problems. This is possible since the solid plane was used as a reference plane for the microstrip line in this embedded AI-EBG structure. In FIG. 32, the cross-section of these three test vehicles are shown. The top view of these three test vehicles is also shown in FIG. 33. The dielectric material of the test vehicles is FR4 with a relative permittivity, $\epsilon_r$=4.4, the conductor is copper with conductivity, $\sigma$=5.8×10$^7$ S/m, and dielectric loss tangent is tan ($\delta$)=0.02. The copper thickness for the microstrip line, solid plane, and AI-EBG plane in the test vehicles is 35 μm, the dielectric thickness between two conductors is 5 mils, and the dielectric thickness of the most bottom layer is 28 mils. For the AI-EBG structures in the second and third test vehicles, the size of the metal patch is 1.5 cm×1.5 cm, and the size of metal branch is 0.1 cm×0.1 cm. It should be noted that the size of the metal patches in the first column near the SMA connector is 1.3 cm×1.5 cm.

Figure 34:
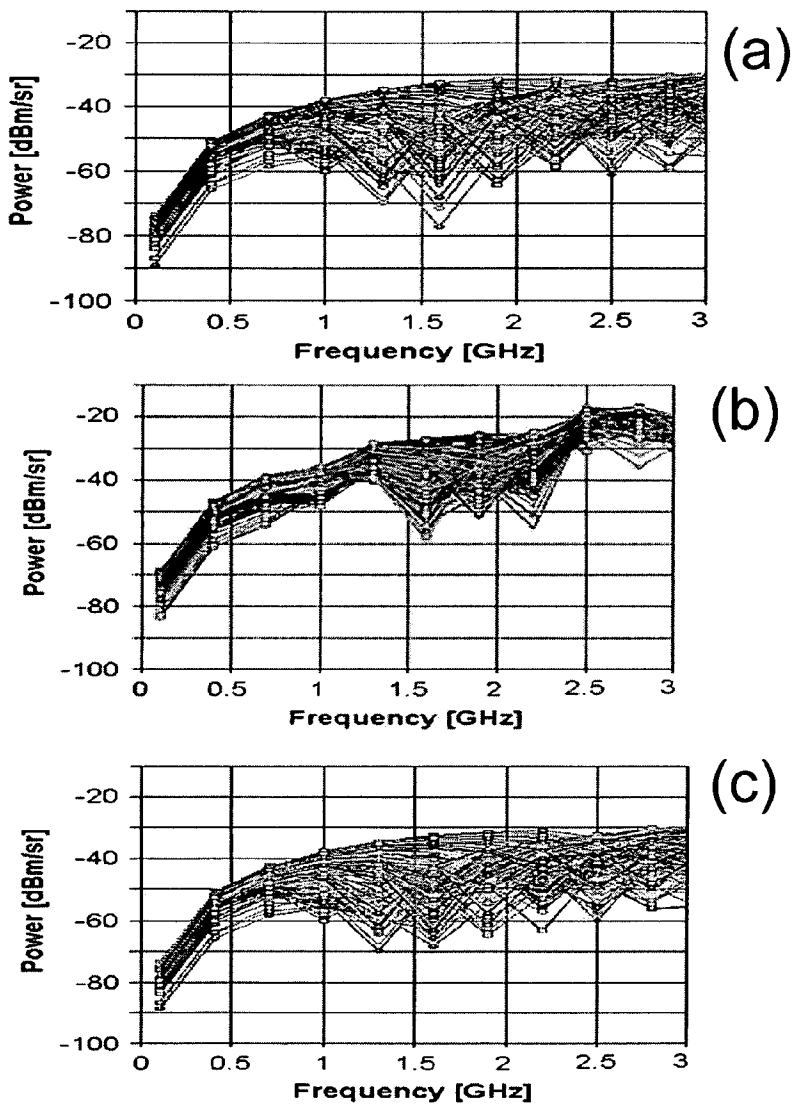
FIG. 34 illustrates far field simulation results: (a) test vehicle 1 (a solid plane as a reference plane), (b) test vehicle 2 (an AI-EBG plane as a reference plane), and (c) test vehicle 3 (a solid plane in an embedded AI-EBG structure as a reference plane).

The far field simulation was performed using SONNET™ for the three test vehicles. In this simulation, surface radiation from the surface of the test vehicles was investigated by changing the degrees (phi=0°~180° at every 10° intervals and theta=−90°~90° at every 10° intervals). FIG. 34 shows far field simulation results for the three test vehicles. It should be noted that test vehicle 2 showed the maximum radiation intensity (after 2 GHz) among the three test vehicles, since the AI-EBG plane was used as a reference plane. The periodic pattern in the AI-EBG plane makes higher radiation in the stopband.

Figure 35:
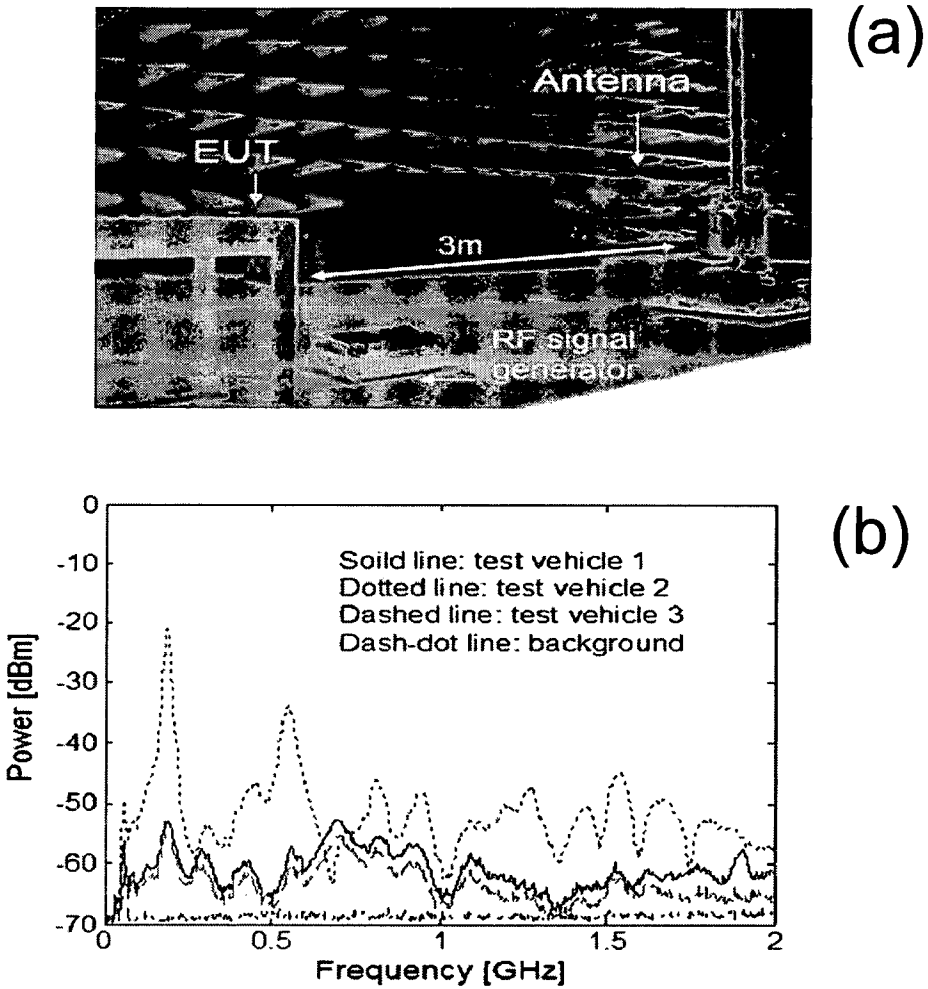
FIG. 35 illustrates a far field measurement set-up and results: (a) measurement set-up for far field measurement and (b) far field measurement results.

To verify the simulation results, far field measurements were done for the test vehicles. The far field measurements were carried out using an Anritsu MG3642A RF signal generator (BW: 125 kHz~2,080 MHz), an Agilent E4440A spectrum analyzer (BW: 3 kHz~26.5 GHz, Res. BW=Video BW=3 MHz), and an antenna in an anechoic chamber. FIG. 35(*a*) shows the measurement set-up for the far field measurements. Since the RF signal generator works properly up to 2 GHz, the far field measurement was also done up to 2 GHz. The distance between EUT and antenna was 3 m in this case. The RF signal generator was connected to EUT as a source, and the spectrum analyzer, which was connected to the antenna, recorded the field intensity from the surface of the test vehicles. In this measurement, radiation intensity from test vehicle 2 is the maximum among the three test vehicles, as shown in FIG. 35(*b*), and test vehicles 1 and 3 showed almost the same radiation intensity because a solid plane was used as a reference plane. It should be noted that the radiated power intensities of the far field measurements in FIG. 35(*b*) are in the range of the simulated radiated power intensities in FIG. 34, except for the peaks at 190 MHz and 550 MHz for the test vehicle 2. To minimize possible EMI problems, the test vehicle with the embedded AI-EBG structure (test vehicle 3) was designed and showed almost the same (or a little better) radiation characteristics than that of test vehicle 1 (reference test vehicle). This test vehicle (test vehicle 3) showed that an embedded AI-EBG structure could be used to suppress noise in mixed-signal systems without causing EMI problems.

Conclusion

In this Example, an efficient method for noise suppression and isolation in mixed-signal systems using a novel EBG structure, called an AI-EBG structure, has been described. The AI-EBG structure has been developed to suppress unwanted noise coupling in mixed-signal systems, and this AI-EBG structure showed excellent isolation (−80 dB to −140 dB) in the stopband. This results in noise coupling free environment in mixed-signal systems. Moreover, the AI-EBG structure has the advantage of being simple and can be designed and fabricated using standard printed circuit board (PCB) processes without the need for additional metal layer and blind vias. The excellent noise suppression in mixed-signal systems with the AI-EBG structure has been demonstrated through measurements, which make the AI-EBG structure a promising candidate for noise suppression and isolation in mixed-signal systems. Signal integrity analysis for the mixed-signal system with the AI-EBG structure has been described, and design methodology has been suggested for avoiding signal integrity and EMI problems. The AI-EBG structure can be made part of power distribution networks (PDN) in mixed-signal systems and is expected to have a significant impact in noise suppression and isolation in mixed-signal systems, especially at high frequencies.

The invention claimed is:

1. A structure comprising:

a first layer, wherein the first layer comprises a signal layer;

a second layer disposed on a back side of the first layer, wherein the second layer comprises a dielectric layer;

a third layer disposed on a back side of the second layer, wherein the third layer comprises a solid metal plane;

a fourth layer disposed on a back side of the third layer, wherein the fourth layer comprises a dielectric layer; and a fifth layer disposed on a back side of the fourth layer, wherein the fifth layer comprises an alternating impedance electromagnetic bandgap (AI-EBG) plane, the AI-EBG plane comprising:

a plurality of first elements disposed on a first plane, each first element comprising a first metal layer, wherein each first element has a rectangular shape; and a second element connecting each first element to an adjacent first element at a position adjacent to the corner of the first element, the second element being disposed on the first plane, the second element comprising the first metal layer, wherein the first elements and second elements substantially filter electromagnetic waves to a stopband floor of about −60 dB to about −140 dB in a bandgap of about 100 MHz to about 50 GHz having a width selected from about 1 GHz, 2 GHz, 3 GHz, 5 GHz, 10 GHz, 20 GHz, and 30 GHz, and having a center frequency positioned at a frequency from about 1 GHz to 37 GHz.

2. The structure of claim 1, further comprising:

a sixth layer disposed on a back side of the fifth layer, wherein the sixth layer comprises a dielectric layer;

a seventh layer disposed on a back side of the sixth layer, wherein the seventh layer comprises a solid metal plane;

an eighth layer disposed on a back side of the seventh layer, wherein the seventh layer comprises a dielectric layer; and a ninth layer disposed on a back side of the eighth layer, wherein the ninth layer comprises a signal layer.

3. The structure of claim 2, further comprising:

a tenth layer disposed on a back side of the ninth layer, wherein the tenth layer comprises a dielectric layer;

an eleventh layer disposed on a back side of the tenth layer, wherein the eleventh layer comprises a solid metal plane;

a twelfth layer disposed on a back side of the eleventh layer, wherein the twelfth layer comprises a dielectric layer; and a thirteenth layer disposed on a back side of the twelfth layer, wherein the thirteenth layer comprises an Al-EBG plane, the Al-EBG plane comprising:

a plurality of first elements disposed on a first plane, each first element comprising a first metal layer, wherein each first element has a rectangular shape; and a second element connecting each first element to an adjacent first element at a position adjacent to the corner of the first element, the second element being disposed on the first plane, the second element comprising the first metal layer, wherein the first elements and second elements substantially filter electromagnetic waves to a stopband floor of about −60 dB to about −140 dB in a bandgap of about 100 MHz to about 50 GHz having a width selected from about 1 GHz, 2 GHz, 3 GHz, 5 GHz, 10 GHz, 20 GHz, and 30 GHz, and having a center frequency positioned at a frequency from about 1 GHz to 37 GHz.

4. The structure of claim 2, further comprising:

a tenth layer disposed on a back side of the ninth layer, wherein the tenth layer comprises a dielectric layer;

an eleventh layer disposed on a back side of the tenth layer, wherein the eleventh layer comprises a solid metal plane;

a twelfth layer disposed on a back side of the eleventh layer, wherein the sixteenth layer comprises a dielectric layer; and a thirteenth layer disposed on a back side of the twelfth layer, wherein the thirteenth layer comprises an Al-EBG plane, the Al-EBG plane comprising:

a plurality of first elements disposed on a first plane, each first element comprising a first metal layer, wherein each first element has a rectangular shape; and a second element connecting each first element to an adjacent first element at a position adjacent to the comer of the first element, the second element being disposed on the first plane, the second element comprising the first metal layer, wherein the first elements and second elements substantially filter electromagnetic waves to a stopband floor of about −60 dB to about −140 dB in a bandgap of about 100 MHz to about 50 GHz having a width selected from about 1 GHz, 2 GHz, 3 GHz, 5 GHz, 10 GHz, 20 GHz, and 30 GHz, and having a center frequency positioned at a frequency from about 1 GHz to 37 GHz;

a fourteenth layer disposed on a back side of the thirteenth layer, wherein the fourteenth layer comprises a dielectric layer;

a fifteenth layer disposed on a back side of the fourteenth layer, wherein the fifteenth layer comprises a solid metal plane;

a sixteenth layer disposed on a back side of the fifteenth layer, wherein the sixteenth layer comprises a dielectric layer; and a seventeenth layer disposed on a back side of the sixteenth layer, wherein the seventeenth layer comprises a signal layer.

5. The structure of claim 1, wherein the stopband floor is about −80 dB to about −120 dB.

6. The structure of claim 1, wherein the stopband floor is about −50 dB to about −120 dB.

7. The structure of claim 1, wherein the bandgap is about 500 MHz to about 3 GHz.

8. The structure of claim 1, wherein the bandgap is 3 GHz to about 8 GHz.

9. The structure of claim 1, wherein the first metal layer is selected from: copper, aluminum, platinum, and combinations thereof.

10. The structure of claim 1, wherein each of the dielectric layers is selected from: FR4, ceramic, and combinations thereof.

11. The structure of claim 1, wherein each of the solid metal planes is selected from: copper, aluminum, platinum, and combinations thereof.

12. The structure of claim 1, wherein the first elements have a dimension of length of about 0.1 cm to about 20 cm, a width of about 0.1 cm to about 20 cm, and a thickness of about 1 mil to about 10 mils.

13. The structure of claim 1, wherein the second element is a shape selected from: a square shape, a rectangular shape, a polygonal shape, a hexagonal shape, a triangular shape, a circular shape, and combinations thereof.

14. The structure of claim 1, wherein the second element is a shape having a dimension of length about 1 mil to about 1 cm, width about 1 mil to about 1 cm, and thickness about 1 mil to about 10 mils.

15. The structure of claim 1, wherein the structure is included in a system selected from: a cellular system, a power distribution system in any mixed-signal package and board, a power distribution system in any high-speed digital package and board, and combinations thereof.

16. A method of fabricating structure having an alternating impedance electromagnetic bandgap (AI-EBG) plane, comprising:

providing a first layer, wherein the first layer comprises a signal layer;

disposing a second layer on a back side of the first layer, wherein the second layer comprises a dielectric layer;

disposing a third layer on a back side of the second layer, wherein the third layer comprises a solid metal plane;

disposing a fourth layer on a back side of the third layer, wherein the fourth layer comprises a dielectric layer; and disposing a fifth layer on a back side of the fourth layer, wherein the fifth layer comprises an alternating impedance electromagnetic bandgap (Al-EBG) plane.

17. The method of claim 16, wherein forming the fifth layer comprises:

forming a plurality of first elements, each first element comprising a first metal layer, wherein each first element has a rectangular shape; and forming a second element connecting each first element to an adjacent first element at a position adjacent to the corner of the first element, the second element being disposed on the first plane, the second element comprising the first metal layer, wherein the first elements and second elements substantially filter electromagnetic waves to a stopband floor of about −60 dB to about −120 dB in a bandgap of about 100 MHz to about 50 GHz having a width selected from about 1 GHz, 2 GHz, 3 GHz, 5 GHz, 10 GHz, 20 GHz, and 30 GHz, and having a center frequency positioned at a frequency from about 1 GHz to 37 GHz.

* * * * *